US011873155B2

(12) United States Patent
Jaramillo et al.

(10) Patent No.: US 11,873,155 B2
(45) Date of Patent: Jan. 16, 2024

(54) INTERFACE CONNECTION DEVICE, KIT, MULTIPLE COMPARTMENT CONTAINER HAVING THE CONNECTION DEVICE FOR MIXING CONTENTS AND METHOD FOR ASSEMBLING SUCH CONTAINER

(71) Applicant: COMPAGNIE GERVAIS DANONE, Paris (FR)

(72) Inventors: Juan-Felipe Jaramillo, Paris (FR); Alex James Orchard, Le Vesinet (FR)

(73) Assignee: COMPAGNIE GERVAIS DANONE, Levallois-Perret (FR)

( * ) Notice: Subject to any disclaimer, the term of this patent is extended or adjusted under 35 U.S.C. 154(b) by 0 days.

(21) Appl. No.: 17/771,229

(22) PCT Filed: Oct. 23, 2020

(86) PCT No.: PCT/EP2020/079851
§ 371 (c)(1),
(2) Date: Apr. 22, 2022

(87) PCT Pub. No.: WO2021/078922
PCT Pub. Date: Apr. 29, 2021

(65) Prior Publication Data

US 2022/0388753 A1 Dec. 8, 2022

Related U.S. Application Data

(60) Provisional application No. 62/925,830, filed on Oct. 25, 2019, provisional application No. 62/925,871, filed on Oct. 25, 2019.

(51) Int. Cl.
*B65D 81/32* (2006.01)
*B65D 51/28* (2006.01)
*B65D 1/04* (2006.01)

(52) U.S. Cl.
CPC ..... *B65D 81/3211* (2013.01); *B65D 1/04* (2013.01); *B65D 51/2835* (2013.01); *B65D 2401/00* (2020.05); *B65D 2401/05* (2020.05)

(58) Field of Classification Search
CPC ..... B65D 81/3211; B65D 51/2835; B65D 2401/05; B65D 2401/00; B65D 25/08; B65D 51/2807
(Continued)

(56) References Cited

U.S. PATENT DOCUMENTS 11,649,104 B2 * 5/2023 Rahmel ..... B65D 21/0231 206/219
2008/0179334 A1 * 7/2008 Abramson ..... B65D 81/3211 220/4.01
(Continued)

FOREIGN PATENT DOCUMENTS

EP 0 293 290 11/1988
EP 3 095 728 11/2016
(Continued)

OTHER PUBLICATIONS

International Search Report for PCT/EP2020/079851, dated Jan. 13, 2021, 5 pages.
(Continued)

*Primary Examiner* — Steven A. Reynolds
(74) *Attorney, Agent, or Firm* — NIXON & VANDERHYE

(57) ABSTRACT

The container is suitable for the separate packaging and storage of at least two contents, which need to be combined in the preparation of a ready-to-use product. Two container bodies each provided with a coupler are assembled by using a separate interface device as intermediate connector. A mixing mechanism is formed when inserting the couplers through opposite annular rings of the connector of the interface device. The interface device includes two openers having a different or opposite orientation, typically arranged inside a same puncturing structure of generally cylindrical shape, for releasing an internal passage initially sealed between two closure members. The closure members respectively close an access opening of the container bodies, hermetically. Relative movement of the closure members toward the openers allows communication between a first compartment and a second compartment.

9 Claims, 10 Drawing Sheets

(58) Field of Classification Search
USPC ..... 206/222, 219
See application file for complete search history.

(56) References Cited

U.S. PATENT DOCUMENTS

| | | | | |
|---|---|---|---|---|
| 2008/0314775 | A1* | 12/2008 | Owoc | B65D 55/0854 206/222 |
| 2011/0180545 | A1* | 7/2011 | Marino | B65D 81/3211 220/568 |
| 2014/0097106 | A1* | 4/2014 | Broekaert | B65D 81/3211 206/222 |
| 2018/0009590 | A1* | 1/2018 | Wong | B65D 1/0246 |
| 2019/0016521 | A1* | 1/2019 | Rahmel | B65D 81/3211 |
| 2020/0391928 | A1* | 12/2020 | Willis | B65B 7/28 |
| 2021/0032005 | A1* | 2/2021 | Weiner | A47G 19/02 |
| 2021/0163209 | A1* | 6/2021 | Jaramillo | B65D 81/3211 |

FOREIGN PATENT DOCUMENTS

| | | |
|---|---|---|
| FR | 2 294 937 | 7/1976 |
| WO | 2012/160117 | 11/2012 |

OTHER PUBLICATIONS

Written Opinion of the ISA for PCT/EP2020/079851, dated Jan. 13, 2021, 9 pages.

* cited by examiner

INTERFACE CONNECTION DEVICE, KIT, MULTIPLE COMPARTMENT CONTAINER HAVING THE CONNECTION DEVICE FOR MIXING CONTENTS AND METHOD FOR ASSEMBLING SUCH CONTAINER

CROSS-REFERENCE TO RELATED APPLICATIONS

This application is the U.S. national phase of International Application No. PCT/EP2020/079851 filed Oct. 23, 2020, which designated the U.S. and claims the benefit of U.S. Application No. 62/925,871 filed Oct. 25, 2019, and U.S. Application No. 62/925,830 filed Oct. 25, 2019, the entire contents of each of which are hereby incorporated by reference.

FIELD OF THE INVENTION

The present invention generally relates to containers used in packaging industry, particularly to containers that separately hold two components of a product until a consumer manipulates the container to cause mixing of the components, the consumer thus obtaining a ready-to-use product, such as a ready-to-eat or ready-to-drink food or beverage product.

BACKGROUND OF THE INVENTION

Upon serving, many food products comprise a liquid phase wherein solid particulate matter is mixed or suspended. In the preparation of such foods, the particulate solids are added to the liquid phase shortly before or at the moment of serving. In many cases it is impossible to maintain the desired organoleptic and texture properties of these foods when the solid component and the liquid component are mixed prior to prolonged storage. For instance, when breakfast cereals are combined with milk a substantial period of time before serving, their texture and mouthfeel change. In consequence, the respective components of such foods are typically separately packaged and distributed and it is left to the consumer to combine them as part of the preparation of a meal.

On the other hand, there is a growing demand for tasteful, convenient food products suitable for on-the-go consumption. More generally, multiple compartment containers are of high interest to provide new convenient use. However multiple compartment containers require many handling operations, such as opening several containers, pouring the content(s), mixing the content etc.

Furthermore, they generate several parts, for example several closures and/or several containers, that are to be discarded for example in a bin. This is not convenient and there is a risk that some part be not correctly discarded and end in a street or public transportation. Accordingly, there is an interest in having containers that cannot be split into several disposable parts. It is more convenient to have a packaging that remains a single compact entity, preferably without separate pack element (like a lid or pull strap) after activation of the mixing.

A dedicated packaging, allowing the separate storage and distribution of two components of a food product in a single package until the moment of consumption, is known from document WO 2012/160117 A1. A multiple compartment injected container is provided to permit the consumption of the food while holding the container with a single hand and with a minimal risk of spilling, even when the consumer performs other activities such as walking, running, travelling, cycling, or driving. Product components are hermetically sealed in their respective container sections and are separate before activation. Upon activation, by moving the container's top section relative to the container's bottom section, one component can be mixed with the other within the internal volume of both container sections.

When consuming the mixture, there is no need to dislodge any one of the compartments from the other. The consumer only makes a simple gesture to actuate the mixing operation (no need to combine several steps). An internal passage for allowing the mixing is released by puncturing a relatively flexible intercompartment membrane. A twist actuation may be performed to cause advance of the piercing means.

In general, the implementation of the industrial production of containers requires that their manufacture relies as much as possible on procedures and components that are standard in the food, beverage and packaging industries, thus lowering the cost and complexity of production.

However, the injected parts of the container described in WO 2012/160117 A1 are complex, and expensive to produce. Moreover, they do not allow a significant range of shapes. In particular, it is difficult to provide a significant volume when injecting an internal housing (for example an internal housing in a cap). Containers thus become expansive to produce.

The compartments can only be obtained by injection molding in the solution of WO 2012/160117 A1, as high accuracy of the fastening structures, which are complex, is required. Moreover, the outer shape of the container cannot significantly vary. The side wall must have a flared shape, typically a substantially truncated cone shape (see FIGS. 49-50 of WO 2012/160117 A1) for removing the respective container parts from a mold. In other words, there is a need for containers that comply with mass production requirements, without strong limitations regarding the technology used to form the outer side wall of the container, and preferably without limitation regarding the design of the outer wall, without limitation regarding the volume of either container (unlike many options which are limited by the injected molded cap dimensions and demolding needs).

Additionally the container disclosed in WO 2012/160117 necessitates filling and sealing the compartments and assembling them in a production facility. Such solution does not allow a user to re-use the parts of the container designed to separated and mix the content upon actuation. Such container also does not allow a user to make its choice of associations of products to be mixed.

Accordingly, there is an interest for multiple compartment containers well adapted to be produced by efficient industrial processes and with various shapes, offering efficient sealing before and after actuation of the mixing (so that the overall container can be resealed mid-use in some options), while providing ease of handling for the users.

There is also an interest for producing multiple compartment containers that are user-friendly, while minimizing amount of disposable plastic material involved in displacing one or more intercompartment membranes. There is a need for multiple compartments containers or elements thereof that can be re-used and/or recycled by a user or consumer. There is a need for multiple compartments containers or elements thereof allowing a user or consumer to make its choice of compartments to be associated. There a need for multiple compartments containers or elements thereof, that can be assembled by a user of consumers with securing a separation first position, activated to mix the contents of the compartment, where at least one element can be re-used and re-assembled with re-securing a separation first position.

SUMMARY OF THE INVENTION

The purpose of the present invention is to provide multiple compartment containers addressing one or more of the above mentioned problems.

To this end, embodiments of the present invention provide a container for keeping contents in separate compartments before use, the container comprising:

- a first container body providing a first compartment for containing a first content;
- a second container body separate from the first container body, the second container body providing a second compartment for containing a second content (the first and second container bodies typically forming a first outer side wall and a second outer side wall, respectively, which are separate sections of an outer sidewall of the container);
- an interface device, separate from the first container body and separate from the second container body, for connecting (typically directly connecting) the first container body to the second container body (the interface device being a coupling device that typically extends axially from an open/annular end of the first container body to an open/annular end of the second container body, the connection optionally being a fluid tight connection);
- an internal passage delimited by the interface device, allowing communication between the first compartment and the second compartment;
- a first closure member sealing the first compartment;
- a second closure member sealing the second compartment, wherein the interface device comprises a connector provided with:

- a tubular wall delimiting an exterior face of the interface device;
- first opening means arranged inside the tubular wall;
- second opening means arranged inside the tubular wall;

and wherein the container has a first configuration, in which the connector comprises a first ring part fastened to a first coupler arranged at an annular end of the first container body, and a second ring part fastened to a second coupler arranged at an annular end of the second container body, wherein in the first configuration, the first closure member comprises a first membrane or other first closing element separating the first compartment from the internal passage and the closure member comprises a second membrane or other second closing element separating the second compartment from the internal passage;

and wherein the connector is configured to allow relative movement of each of the first container body and the second container body relative to the connector, in order to allow mixing between the first content and the second content in a second configuration of the container (the mixing being performed, for instance, in a superimposed configuration of the first container body and the second container body), by engaging:

- the first opening means in an activated position to open the internal passage by opening the first membrane or (more generally) said first closing element, and
- the second opening means in an activated position to open the internal passage by opening the second membrane or (more generally) said second closing element.

Optionally, at least one of the first and second opening means is a puncturing structure. The opening of at least one packaging unit including the first or second container body can be done by puncturing the membrane sealing the compartment of the corresponding container body.

The container enables a simple convenient gesture to break a separation, typically two seal membranes between two container bodies or similar hermetic seals between two packaging units/containers.

Typically in the first configuration, the internal passage is closed (preferably hermetically closed) and extends between the first membrane and the second membrane.

The arrangement of the container with the interface device is compatible with requirements of mass production, while offering a wide choice for geometry for the first container body and the second container body.

Thanks to the interface device coupling the two container bodies, there is no specific constraint on the type of container sections that can be connected. Hence, the container can be more cost-effective than e.g. solutions with injection molded container sections including the coupling features.

Additionally the usage generates a limited number of separated elements to be individually discarded, thus helping keeping clean the vicinity of the usage area.

Any kind of content, preferably flowable content, may be used to form the two initially separate components. The components are not necessarily food components or pharmaceutical/cosmetics components. In some embodiments, at least one of the two contents may be chosen amongst flowable construction materials (concrete glues, polyurethane components) or in chemistry field.

One of the two components may be a dairy or plant-based dairy analogue component. Preferably, one of the components has greater density than the other component and/or is not in same physical state (for example one component is solid while the other component is liquid).

After use, the container is designed to be recyclable, the side wall section being for instance made of same thermoplastic material.

The container can typically have an outer sidewall extending between two opposite ends: one end being the first end of the first container body and the other end being the opposite end/second end of the second container body.

Such outer sidewall is continuous, the interface device optionally forming an intermediary part of the outer sidewall (directly between the first container body and the second container body).

The container bodies may be blown/blow molded pieces and/or formed in cost-effective manner (typically with higher production rate and/or with greater saving of plastic material). The size and shape of the first and second container bodies may greatly vary as limitations encountered for injection molding do not exist in blowing technology. In other options, one or more of the container bodies include or are made of metal. For instance, at least the first container body is a metal body. In an embodiment both container bodies are metal bodies. In one embodiment the first container body, the second container body and/or both container bodies are glass bodies. Glass bodies can be easily recycled, returned and/or re-used.

In a preferred embodiment, the mutually facing annular ends of the container bodies are open ends of same size and shape, so that the container may have a regular/balanced sidewall.

At least the side wall of the first container body may be of same cross-section as the outer face of the fastening flanges that belong to the interface device. For instance, a cylindrical shape is provided in the first container body at least in a portion adjacent to the interface device. More generally, the container may be deprived from any outer bulge formed at the interface device or adjacent to the interface device, whereby the outer aspect of the container is perceived as regular at location of the interface device, without abrupt change of section.

The interface device acts as a coupling device to allow a predetermined movement of the first container body that includes the first coupler (which is for instance a male coupler when including an inserting part inside a first ring part of the connector) relative to the connector (female part with the first ring part receiving and guiding the inserting part of the first coupler). The interface device also acts as a coupling device to allow a predetermined movement of the second container body that includes the second coupler (which is for instance a male coupler when including an inserting part inside a second ring part of the connector) relative to the connector (female part with the second ring part receiving and guiding the inserting part of the second coupler).

Such predetermined movement, for instance a simple twist action, typically a quarter turn (or less than a half turn), causes release of the internal passage as the membranes are pierced by the puncturing structure or displaced similarly by the opening means. The movement can be "predetermined" as there is one or more guide elements and/or one retaining element that prevent the inserting part of a container body to detach from the corresponding ring part of the connector, whereby the mating of these fastening parts only allows for a determined relative movement, preferably a twist movement with reduction of the total height of the interface device as measured from one axial end to the other axial end of the interface device.

According to an option, each membrane (intermediate seal between the compartments) is displaced to be out of the way of the flow between both container sections.

Optionally, the first opening means and the second opening means form two series of teeth included in a same rigid plastic part, the two series of teeth being orientated according to two opposite directions.

The opposite directions may be parallel to a longitudinal axis of the connector, and this axis may be a central axis of annular structures forming respectively the two series of teeth. Optionally, the longitudinal axis may intersect a container bottom formed as a bottom wall of the first container body.

Typically, the first closure member is connected to a circumferential attachment surface of the first container body, preferably adjacent to a free annular end of the first container body so as to extend in between the two adjacent compartments. The same may apply for the second closure member, connected to a circumferential attachment surface of the second container body.

After causing the puncturing of the intercompartment membrane, the container is designed to be shaken/mixed and then dispensed. The first compartment and the second compartment may be complementary sub-volumes of a whole interior volume of the container.

The puncturing structure comprises a plurality of piercing members and is rotationally integral to the connector. When taking the opening means, typically formed by a puncturing structure, as a stationary reference, each of the closure members is moved from a distal position to an initial position. The distal position is possibly axially spaced less than 4 or 5 mm from piercing members of the puncturing structure.

According to an aspect, the puncturing structure has a series of teeth, which is designed and oriented with respect to a facing membrane so that movement in a first direction, of the first container body, relative to the connector, causes a movement in this first direction towards the piercing members such that the piercing members can partially pierce the membrane, while a connection is maintained between the closure member (that includes the pierced membrane) and a portion of the circumferential attachment surface.

Typically, the puncturing structure also has another series of teeth, which is designed and oriented with respect to the other facing membrane so that movement in a second direction (opposite to the first direction), of the second container body, relative to the connector, causes a movement in this second direction toward the piercing members such that the piercing members can partially pierce the membrane.

Optionally, the movement of the second container body may be actuated by grasping the container at the second outer side wall formed by the second container body, possibly by rotating/twisting in opposite directions the first container body and the second container body.

According to an option, the interface device acts as a coupling device to allow a predetermined movement of the connector relative to the first container body, such predetermined movement including an axial movement (downward or upward movement) of the puncturing structure, which causes the traversal of at least part of piercing members or cutting edge of the puncturing structure beyond a virtual plane defined by the membrane in its initial state before piercing/puncturing.

After the first membrane is pierced, it can be folded downwardly, due to the weight of content placed above the membrane, when the first compartment and the second compartment are in a superimposed configuration. Typically, the actuation movement may be a rotation around the longitudinal/central axis of the connector and the interface device may be provided with one or more cam surfaces or threads to axially guide the puncturing of the membrane. The same applies for piercing the second membrane, which can be folded upwardly.

In the folded state, at least part of the pierced membrane may extend between the puncturing structure and a wall delimiting the corresponding compartment.

Furthermore, it is preferred that each membrane is substantially perpendicular to a longitudinal axis of the container that forms a central axis of the interface device (that is of annular shape).

Optionally, the connector of the interface device, which includes the first and second opening means, is a single piece made of metal or of thermoplastic material, for instance an injection molded piece.

The connector comprises, separately from the first container body and from the second container body, a circumferential row of sharp-edged piercing members or a slanted cutting edge. Preferably, rotating movement of the second container relative to the first container causes a predetermined movement of the connector toward the first compartment, with a movement of the cutting edge of the piercing means such that the edge of the circumferential piercing member(s) pierces the intercompartment membrane along a partially circumferential piercing path.

The cutting edge may be at least partly helical, possibly extending with a constant slope so that the cutting edge has a free end at a lowermost end. Such helical configuration may be similar (with same orientation/not inverted) as compared to helical distribution/arrangement, in the connector, of inner thread element(s) guiding rotation between the connector and the first container body. The inner thread element(s) are provided in an inner face of the tubular outer wall of the connector. Typically, in the piece forming the connector, a first part of these inner thread element(s) extends below the level of the cutting edge and a second part of these inner thread element(s) extends above the level of the cutting edge.

More generally, it is understood that a connection can be maintained between the pierced membrane and the container through a non-pierced segment of the membrane that remains integral with an annular margin portion of the closure member.

In various embodiments of the container of the invention, recourse may optionally also be had to one or more of the following dispositions:

- the first opening means and the second opening means are included in a same plastic part, which is a cylindrical part of the connector arranged coaxially inside the tubular wall.
- the cylindrical part extends between two edges of irregular shape, the two edges forming respectively the first opening means and the second opening means.
- the edges may be provided with cutting edges or may simply be provided with a wavy profile.
- the teeth formed by the cylindrical part edges or similar pushing and/or puncturing structure may be arranged circularly or partly circularly, around a longitudinal axis of the connector.
- at least one amongst the first opening means and the second opening means is a puncturing structure, each puncturing structure being configured for puncturing one membrane chosen amongst the first membrane and the second membrane.
- the cylindrical part is a rigid part of the connector, configured to partly extend within an open part of the first container body and within an open part of the second container body, simultaneously, in the second configuration (a telescopic arrangement may thus be provided).
- the interface device consists in the connector, which is a single piece of annular shape.
- the connector is made of thermoplastic material intended to come into contact with food.
- the connector longitudinally extends around a longitudinal axis and comprises a first inner face for guiding movement of the first coupler and a second inner face for guiding movement of the second coupler and at least one transverse wall portion at an intermediate position between the first inner face and the second inner face.
- the transverse wall portion protrudes inwardly from the tubular wall of the connector.
- the first and second inner faces may be formed by the tubular wall of the connector.
- the first ring part is typically, provided with the inner face and the second ring part is provided with the second inner face.
- the container comprises an electrically conducting layer, typically a metal layer, and preferably a layer containing aluminum, adjacent to an annular contact area for contact between a coupler of a container body and the closure members, the closure members being induction sealed to a container body at the annular contact area.
- the connector of the interface device, which is a single piece of plastic or metal; preferably more rigid than any one of the container bodies, can be an injection molded piece of thermoplastic material, for example chosen from any one of the following groups:
  - Polyolefines, including but not exhaustive: hdPE, ldPE, lldPE, PP, PP copo random, or a mix of them;
  - Polyesters: such as PET, PLA, PETg;
  - Polycarbonate, PVC, PS.
- optionally, the connector of the interface device is made of thermoplastic material without any mineral foil.
- at least one of the first container body and the second container body is made of thermoplastic material without any mineral foil; Typically, the first container body and the second container body are each a single-piece of thermoplastic material and/or a blow molded part.
- the interface device can be activated by a twist movement to obtain a final height of the interface device, which is decreased compared to the initial height.
- the connector is of a screw-on type relative to the first coupler and/or relative to the second coupler and there is an abutment element to limit rotation between them, the angle of the full rotational movement being adjusted from 10-270 degrees, and preferably being less than 100 degrees and more than 45 or 50 degrees.

In some options, the container of the invention may also be provided with one or more of the following dispositions:

- in the first configuration, the first closure member extends, preferably planarly, between an annular rim included in the annular end of a neck that belongs to the first container body and the at least one transverse wall.
- in the first configuration, the second closure member extends, preferably planarly, between an annular rim included in the annular end of a neck that belongs to the second container body, and the at least one transverse wall.
- each annular rim is configured to delimit an open part of the corresponding container body.
- the couplers, formed at facing ends of the container bodies, may each axially abut against the transverse wall, which thus acts as an abutment member to limit axial displacement of the container bodies that approach each other.
- the interface device comprises a first housing and a second housing each of annular shape and delimited inwardly by an outer periphery of a cylindrical part of the connector, the cylindrical part having an inner face that delimits the internal passage.
- at least one of the openers, preferably each opener is included in the cylindrical part.
- the first opener is included in a lower annular end of the cylindrical part, the first housing opening downwardly for accommodating a neck or similar coupler of the lower container body.
- the neck of the lower container body is guided along the cylindrical part and may include one or more outer reliefs for interlocking the neck in the connector, between the connector outer wall and the cylindrical part including the opener.
- the one or more outer reliefs engage in abutment between two inner stops (forming a pair of stops, arranged as two spaced protrusions) when the lower container body is in the first insertion position.
- the inner stops are axially spaced.
- the inner stops consist in several abutment reliefs, which are adapted for receiving and locking an annular bead in the first insertion position, the annular bead extending above all or part of the abutment reliefs formed on the lower ring part (the first ring part) in the second insertion position.

the inner stops are distributed in pairs, preferably along a guiding structure of the connector with different axial positions for the respective pairs, each pair of stops delimiting an interspace for receiving a complementary outer relief formed in the coupler of the first container body.

in the second configuration, the annular end of the first container body extends inside the first housing and the annular end of the second container body extends inside the second housing.

the first membrane is in direct annular sealing contact with a first annular rim included in the first container body, the first annular rim forming a top of a neck that is connected to a cylindrical wall of the first container body by an annular shoulder.

the neck is annularly covered by the connector in the second configuration.

the neck defines the first coupler and is provided with an outer fastening surface configured to be rotatably engaged on the first ring part of the connector.

the neck is a single wall neck (without any hollow or double wall configuration with spacing).

the second membrane is in direct annular sealing contact with a second annular rim included in the second container body, the second annular rim forming a lowermost face of an inverted neck that is connected to a cylindrical wall of the second container body by an annular shoulder.

the inverted neck is annularly covered by the connector in the second configuration, the neck and the inverted neck extending circularly around a same central axis.

the inverted neck defines the second coupler and is provided with an outer fastening surface configured to be rotatably engaged on the second ring part of the connector.

the first container body and the second container body are superimposed via the connector and configured to activate the first and second opening means included in the connector and thus obtaining the second configuration of the container, typically when rotated or twisted in opposite directions.

each of the first and second couplers has one or more threads, so that in the second configuration, in which the first ring part remains fastened to the first coupler and the second ring part remains fastened to the second coupler, the connector is a fluid-tight connector preventing any loss of content between the first compartment and the second compartment.

the connector comprises a retaining element, the first coupler being provided with an abutment element configured to engage with the retaining element so as to prevent the connector from being accidentally detached from the first container body.

the connector comprises a retaining member, preferably a notch, capable of engaging with another abutment element provided in the first coupler so as to rotationally lock the first container body relative to the connector, in the second configuration.

the interface device is of annular shape and extends around a longitudinal axis.

the first container body has a first outer side wall extending around the first compartment, the second container body having a second outer side wall extending around the second compartment.

in the second configuration, the tubular wall separates, in an outer sidewall of the container, the first outer side wall from the second outer side wall.

the first container body has an end, possibly a lower end forming a container bottom wall, the first annular rim being provided opposite to this end.

the second container body has an end, possibly an upper end forming a container top opened part opposite to the end of the first container body.

the second container may have a neck provided with a second annular rim that is configured to delimit an open part of the first container body.

the connector defines a container outer wall section of a first outer diameter, which is longitudinally and directly interposed between the first and second outer side walls, respectively included in the first container body and the second container body.

the first and second outer side walls have the same second outer diameter that is equal or superior to the first outer diameter; more generally, at least one of the container body may be provided with an outer diameter superior or equal to the container outer diameter defined at the interface device.

in the first configuration, two opposite axial ends of the interface device are spaced to define a maximal height of the interface device, while in the second configuration, the two opposite axial ends of the interface device are spaced to define a lower height of the interface device as compared to the maximal height.

the interface device further comprises at least one elongated tamper-evidence element each having two opposite edges, one of the two opposite edges being connected to the connector and the other one being connected to one amongst the first container body and the second container body.

each tamper-evidence element may be connected to a shoulder of the container body.

each tamper-evidence element is tearable.

the container has a top opening for pouring the mixture, delimited by the second container body which is a single piece.

the container has a single opening, preferably of lower size than the internal passage. If the opening and the internal passage are of circular section, the diameter of the internal passage may optionally represent between 110 and 400%, preferably between 130 and 270%, of the diameter of the single opening.

the container opening is formed at an axial end of the container, and may be arranged in a neck, typically a threaded neck.

a typically rigid cap and/or flexible lid is provided to close the container opening.

the cap may be essentially made of thermoplastic material, typically chosen in the group of polyolefines, which includes (but not exhaustive) hdPE, ldPE, lldPE, PP, PP copo random, or a mix of them, or in the group of polyesters, such as PET, PLA, PETg Polycarbonate, PVC.

at least one of the first container body and the second container body is a single-piece of thermoplastic material and/or a blow molded part, preferably cut from a pre-container.

at least one of the first container body and the second container body contains paper, aluminum, metal (preferably steel), glass, or a paper/PE multilayer structure.

the interface device includes an outer part that separates, in the outer side wall of the container, the first outer side wall from the second outer side wall.

the connector comprises an annular bearing portion, axially protruding toward the second container body from an annular radial portion of the ring part.

each ring part is configured to guide movement of a corresponding coupler.

each coupler axially abuts against a stopper included in the connector, to limit axial displacement between the opening means and the corresponding coupler supporting a membrane.

at least one of the first container body and the second container body is made of glass and at least one of the first and second ring parts comprises an elastically deformable part, which is locally thinner than a remainder of the connector and/or delimited between two slots, preferably two longitudinal slots, a retaining element being provided in the elastically deformable part.

The connector may be provided with any kind of appropriate inner guiding face, which provides a contact (possibly radial contact) for guiding the rotation of the coupler, so that clockwise or counter-clockwise rotation of a second container body around the connector's longitudinal axis may be actuated by a user's hand when the connector alone and/or the first container body are firmly grasped in the other hand which is stationary.

The two contents are capable of being mixed together in a quick and easy fashion immediately prior to consumption for complete freshness. Such mixing can be performed for two or more product components, at the point of use in a portable affordable pack system.

Typically, the container is provided with a pouring opening or any kind of suitable opening, typically at an end of the container away from the coupling element formed by the interface device. With such an arrangement, the container also permits opening of the container (for instance at the opposite from a container bottom), for consumption of a first content from the container, and subsequent manipulation of the container to mix or release a second content for consumption from the container. Indeed, a consumer could desire to have a mixture with a higher proportion of the first content and separately retrieve an unmixed part of the second content (or vice versa).

In various embodiments of the container of the invention, the hollow bodies used to form the first container body and the second container body may be provided with one or more of the following features:

the mutually facing annular ends of the container bodies are threadless (indeed, there is no need for removable connection with respect to the connectors of the interface device).

each container body is made of a plastic material more flexible than the plastic of the interface device and/or has a maximum thickness in a flexible part of the side wall (for instance substantially in the middle of the corresponding body) which is inferior to a minimum thickness of the interface device measured between an inner face and an outer face of the interface device, apart from the puncturing structure.

the annular side wall of each container body defines a single annular side wall of the hollow body and is formed by a single layer of plastic material.

one or each of the container bodies is a blow molded piece made of a material chosen in the group of Polyesters, such as PET, PLA, PETg.

one or each of the container bodies is a blow molded piece made of a material chosen in the group of Polyolefines, including but not exhaustive: hdPE, ldPE, lldPE, PP, PP copo random, or a mix of them.

one or each of the container bodies is a blow molded piece made of Polycarbonate, PVC, PS Mix of one of the here above plastics.

at least one of the container bodies includes or is made of Paper, Aluminum, Metal (steel), Glass, Paper/PE multilayer structure.

When including blow molded bodies, it is understood that the container side wall can be of lighter weight compared to a side wall of an injection molded plastic body component. The container bodies may be obtained at lower cost related to the plastic material, and with lower environmental footprint.

An average thickness may be calculated in a known manner, without compressing the plastic material and by measuring it in a plurality or regularly spaced locations (typically with at least five measurements).

Of course, in the instant specification, the term "annular" should not be here interpreted in any strict manner, provided that the corresponding shape defines a ring-like closed section, typically around a central axis. This does not exclude any straight segments as perceived in the cross section, and polygonal shapes or partly polygonal shapes may be interpreted as annular shapes in this context.

But, in a preferred embodiment, the annular end of each container body delimits a generally circular opening or strictly circular opening (without any straight segment), and the neck forming the coupler in each container body may be generally circular.

According to a particular feature, the first container body, the second container body, the interface device, the cap or lid have their respective inner faces each defined by a material suitable for food contact. The sealing elements may also have such material suitable for food contact, at least in a face opposite from the interface device.

According to an aspect, it is provided an interface connection device between a first container body containing a first content and a second container body containing a second content, the device delimiting an internal passage and comprising a connector of annular shape provided with:

a first end female part for receiving a corresponding male part that is formed as a first coupler of the first container body and is bearing a first membrane sealing a first compartment delimited in the first container body, the first end female part forming a first outer open face of the connector;

a second end female part for receiving a corresponding male part that is formed as a second coupler of the second container body and is bearing a second membrane sealing a second compartment delimited in the second container body, the second end female part forming a second outer open face of the connector;

a first opener or first opening means, comprising a first contact end or edge that is facing outwardly in a first direction and provided for selectively displacing all or part of the first membrane toward the first direction, preferably by folding back the first membrane along an inner surface of the first coupler;

a second opener or second opening means comprising a second contact end or edge that is facing outwardly in a second direction away from the first direction, and provided for selectively displacing all or part of the second membrane toward the second direction, preferably by folding back the second membrane along an inner surface of the second coupler; whereby the connector is a double opener connector.

Typically, at least one of the first and second end female parts provides a first insertion position and a second insertion position for the corresponding male part, the device comprising at least one retaining element interfering with displacement from the first insertion position to the second position so that the first insertion position is a predetermined position (such position can be obtained and maintained when installing the openers between the two compartments respectively formed by the first container body and the second container body, before actuating any one of the openers by a displacement of a coupler/male part toward its second position).

The device may be configured to permit passing from the first insertion position to the second insertion position upon an actuation action and/or an unlocking action exerted for allowing the first and second membranes to be respectively displaced by the first and second openers, so that the first and second compartments are open toward the connector and the internal passage thus selectively allowing communication between the first compartment and the second compartment.

Such device is provided with an integral protection mechanism, with retaining elements included in the connector or irremovable relative to the connector. Accordingly, the protection mechanism is still present if the connector is re-used. The connection device may thus be reusable without any particular change in the structure of the device.

In some options, the interface connection device of the invention may also be provided with one or more of the following dispositions:

the at least one retaining element is included in or secured to the connector (fixedly attached to the connector) in order to be irremovable relative to the connector.

the at least one retaining element comprises a first irremovable retaining element that is: attached to the connector at the first end female part and displaced toward the second end female part upon the unlocking action (the unlocking action possibly being a direct displacement of the first irremovable retaining element).

the connector is a single piece of plastic material provided with an intermediate part including an annular peripheral junction joining the first end female part and the second end female part.

the connector is provided with a tubular wall delimiting all or part of an exterior face of the interface device, the annular peripheral junction being included in the tubular wall.

each of the first and second end female parts provides a first insertion position and a second insertion position for the corresponding male part.

at least one first irremovable retaining element, included in or secured to the first end female part of the connector in order to be irremovable relative to the connector, is interfering with displacement from the first insertion position to the second position so that the first insertion position is typically a predetermined position inside the first end female part.

at least one second irremovable retaining element, included in or secured to the second end female part of the connector in order to be irremovable relative to the connector, is interfering with displacement from the first insertion position to the second position so that the first insertion position is typically a predetermined position inside the second end female part.

the connector is a double opener connector made of a single piece of plastic or metal material, longitudinally extending around a longitudinal axis.

the at least one first irremovable retaining element and the at least one second irremovable retaining element comprise two pieces that are each irremovably secured to a respective fastening and guiding part, preferably a fastening groove included in the tubular wall, the two pieces optionally surrounding the first end female part and the second end female part which are included in the tubular wall.

the two or more pieces forming the irremovable retaining element are formed as axially opposite parts protruding in opposite directions relative to the tubular wall.

the two pieces are two protecting rings configured to slide each in a corresponding groove that belongs to a pair of fastening grooves that are external grooves of the connector configure to allow the two protecting rings to be rotated around a longitudinal axis of the connector and to be axially displaced along direction the longitudinal axis.

the at least one first irremovable retaining element comprise first inner reliefs of the tubular wall.

the at least one second irremovable retaining element comprise second inner reliefs of the tubular wall;

the intermediate part comprises a radial part or transverse wall transversally connecting the tubular wall to a cylindrical part that includes the first contact end or edge and the second contact end or edge, the tubular wall and the cylindrical part delimiting two (separate) housings separated by the transverse wall.

the first contact end is provided with a first opener pressing portion or edge, the first opener being arranged between the internal passage and the first end female part and extending from a first opener base part to the first end.

the second contact end is provided with a second opener pressing portion or edge, the second opener being arranged between the internal passage and the second end female part.

the first inner reliefs are axially closer from the first outer open face than from the transverse wall.

the second inner reliefs are axially closer from the second outer open face than from the transverse wall.

the first end female part is formed as a first ring part and the second end female part formed as a second ring part.

in an option, an annular sealing contact, preventing any leak of liquid outside from the internal passage, is created between the respective inner faces of the first ring part and the second ring part and the corresponding male part, when passing from the first insertion position to the second insertion position.

in another option, an annular sealing contact, preventing any leak of liquid outside from the internal passage, is already created between respective inner faces of the first ring part and the second ring part and the corresponding male part, in the first insertion position before passing from the first insertion position to the second insertion position.

the annular sealing contact is preferably obtained by, either an annular radial contact, against an outer surface of the coupler, provided by a contact surface of a flexible annular lip included either in the inner face or in the outer surface of the coupler, or a screw-type connection between an outer surface of the coupler and a contact surface of the inner face.

each retaining element is included in the connector to be irremovable, preferably by being formed integrally with the connector in a same annular piece of plastic, and is optionally formed in an inner face included in one amongst the first ring part and the second ring part.

each irremovable retaining element may be in blocking contact with at least one of the container bodies in a non-active configuration of the connector, in which the first insertion position is obtained for the two male parts, the blocking contact preventing obtaining the second insertion position; and each irremovable retaining element may be provisionally locking the non-active configuration and preventing at least one of the membranes to be displaced toward an open state each irremovable retaining element may be displaceable or elastically deformable or compressible to allow passing from the first insertion position to the second insertion position and vice versa.

the internal passage is selectively allowing communication between the first compartment and the second compartment in an active configuration of the connector.

in the active configuration, the first and second container bodies are interconnected via the connector, the second position is obtained for the two male parts, and the first and second membranes are respectively displaced by the first and second openers so that the first and second compartments are open toward the connector.

the first end female part and the second end female part are integral and inseparable parts of the connector.

at least one of which comprising an inner face provided with an inner guiding track that includes a first coupling section and a second coupling section; and at least one stopper forming the retaining element configured to provisionally block the corresponding coupler in an intermediate position along the inner guiding track, which is a predetermined position each of the first opening means and second opening means is arranged in an interior volume delimited by the tubular wall and optionally belong to a same cylindrical part.

According to an aspect, it is provided a kit for assembling a container having separate compartments (container such as above mentioned), the container allowing keeping contents in the separate compartments that are distributed in a first container body and a second container body, the kit comprising:

at least one container body forming at least one of the first container body and the second container body, each container body having a membrane sealing a container body compartment and a coupler arranged at an annular end of the container body which is sealed by a given membrane, the interface connection device that is of annular shape.

Typically, the interface connection device of the kit is suitable for connecting the first container body to the second container body, the at least one retaining element being included in or secured to the connector in order to be irremovable relative to the connector.

The kit preferably comprises the first container body and the second container body.

Optionally, the coupler is passing from the first insertion position to the second insertion position by moving the coupler relative to the connector (30), while the at least one retaining element is simultaneously kept in a predetermined position so that it remains stationary relative to the connector (in other words, the retaining element may be an element as stationary as the connector, when opening of the compartments implies displacing the container bodies towards each other).

The interface device of the kit has a tubular wall delimiting an exterior face of the interface device and comprises:

two guiding tracks distributed at the first end and second end female parts, in the tubular wall, the two guiding tracks comprising a first track extending at a first inner face included in the tubular wall and a second track extending at a second inner face included in the tubular wall;

a first housing and a second housing each delimited outwardly by the first inner face and the second inner face, respectively, and delimited inwardly by an outer periphery of a cylindrical part of the connector, the cylindrical part having an inner face that delimits the internal passage, the internal passage being able to be sealed between two membranes in an assembled state of the container before mixing the contents.

In the kit, the coupler of the at least one container body is removably fastened to one of the two guiding tracks, each of the two guiding tracks comprising a transition relief forming all or part of the retaining element and separating a front track section from a rear track section, so that the coupler is adapted to be actuated, by passing over the transition relief:

from a first position, in which the coupler is engaged in the front track section so that the coupler is axially facing a determined housing amongst the first housing and the second housing, the given membrane being unengaged by any of the opening means in the first position;

to a second position, in which the coupler is engaged in the rear track section so that the coupler and a margin portion of the given membrane penetrate the determined housing and one of the opening means has engaged the given membrane to allow the internal passage to be filled with content.

It is understood that the internal passage is allowing mixing of the contents initially stored in the separate compartments when the first container body and the second container body are connected by the interface device and have their coupler in the second position.

It is also provided a method for assembling or producing a container of the invention, of the type having a first container body and a second container body operatively coupled to the first container body via an interface device that includes a connector, the method comprising:

providing the first opening means and the second opening means in a connector forming all or part of an interface device, the connector comprising a tubular wall delimiting an exterior face of the interface device, the first opening means and the second opening means being arranged inside the tubular wall;

coupling and fastening the first container body, which is already filled with the first content in the first compartment delimited by the first container body, to one of two opposite axial ends of the interface device;

coupling and fastening the second container body, which is already filled with the second content in the second compartment delimited by the second container body, to the other one of two opposite axial ends of the interface device;

maintaining a first configuration of the container, in which the first opening means are facing a first closure member sealing the first compartment and the second opening means are facing a second closure member sealing the second compartment, so that an internal passage delimited by the tubular wall of the interface device and allowing communication between the first compartment and the second compartment remains closed by a first membrane of the first closure member and a second membrane of the second closure member, wherein the connector is fastened to a first coupler of the first container body and to a second coupler of the second container body, which permit narrowing a distance between the first coupler and the second couplet to obtain a second operative configuration of the container, in which the first opening means opens the internal passage by puncturing and/or displacing the first membrane and the second opening means opens the internal passage by puncturing and/or displacing the second membrane, thus allowing mixing between the first content and the second content.

Typically, a first insertion position and a second insertion position of any one of the couplers are provided by the least one of the first and second ring parts of the connector, the device comprising at least one retaining element, involved in maintaining the first configuration and preferably irremovable relative to the connector, which interferes with displacement from the first insertion position to the second position so that the first insertion position is typically a predetermined position.

Optionally, the method comprises passing from the first insertion position to the second insertion position upon an actuation action and/or an unlocking action exerted to relatively slide and/or rotate the connector relative to the container bodies for allowing the first and second membranes to be respectively displaced by the first and second openers, so that the first and second compartments are open toward the connector and the internal passage thus selectively allowing communication between the first compartment and the second compartment.

According to an optional embodiment, the first configuration of the container is maintained by preventing relative rotation and/or sliding between the connector and each of the first container body and the second container body, by rigid protecting parts irremovably secured to the connector (typically adapted to but against the container bodies), which are protruding in opposite directions relative to the connector, in order to prevent displacement of the first and second container bodies towards each other, the rigid protecting parts being preferably two protecting rings.

In some embodiments, the first configuration of the container is maintained by preventing rotation relative to the connector of each of the first container body and the second container body, by tamper evidence means (bands or frangible linking members). The tamper evidence means may preferably be two tamper evidence bands distributed at the two opposite axial ends.

Herein all features the features concerning the container, the container bodies and/or the interface connection devices can be applied similarly with reference to connection devices, kits, assemblies, production methods, assembling methods or usage methods.

Other features and advantages of the invention will become apparent to those skilled in the art during the description which will follow, given by way of a non-limiting example, with reference to the appended drawings.

DETAILED DESCRIPTION OF EMBODIMENTS

In the various figures, the same references are used to designate identical or similar elements.

Figure 1:
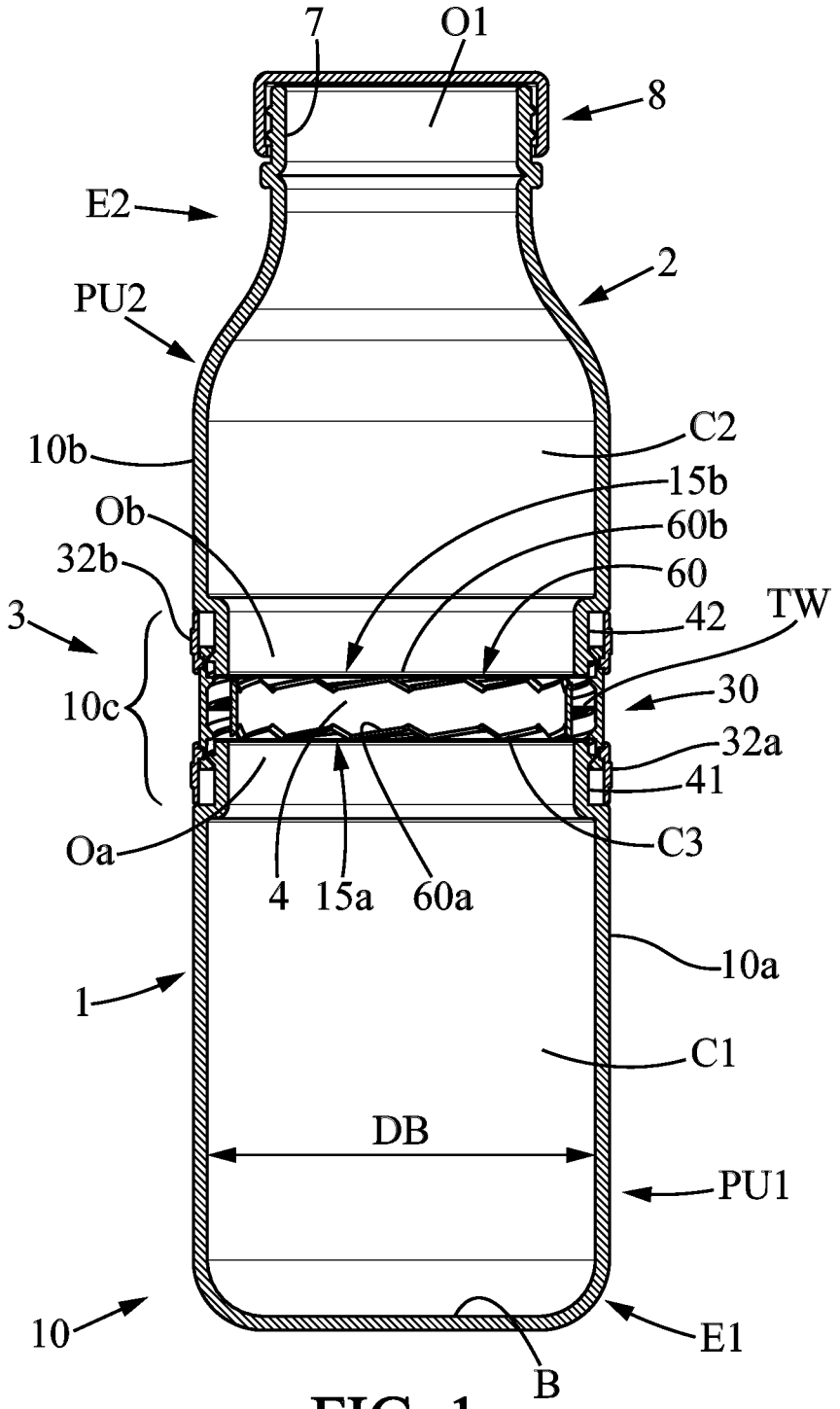
FIG. 1 is a longitudinal cut-away view showing a multiple compartment container in an embodiment in accordance with the invention, with an interface device interposed between two container bodies.

Referring to FIG. 1, the container 10 may form a bottle having at least two compartments C1, C2 that are optionally superimposed. The container 10 is here provided with a first container body 1 and a second container body 2, which are used to form the outer sidewall (10*a*, 10*b*, 10*c*) of the bottle-like container 10. Optionally, such outer sidewall has at least three wall sections: a first wall section 10*a* included in the first container body 1, a second wall section 10*b* included in the second container body 2 and a third intermediate wall section 10*c* included in an interface device 3 that is separate from the first container body 1 and the second container body 2.

In some options, the container 10 may form a cup. The number of compartments C1, C2 can vary. In particular, any one of the container bodies 1, 2 may define several compartments rather than a single compartment C1 or C2.

Interior of the Multiple Compartment Container

Figure 8:
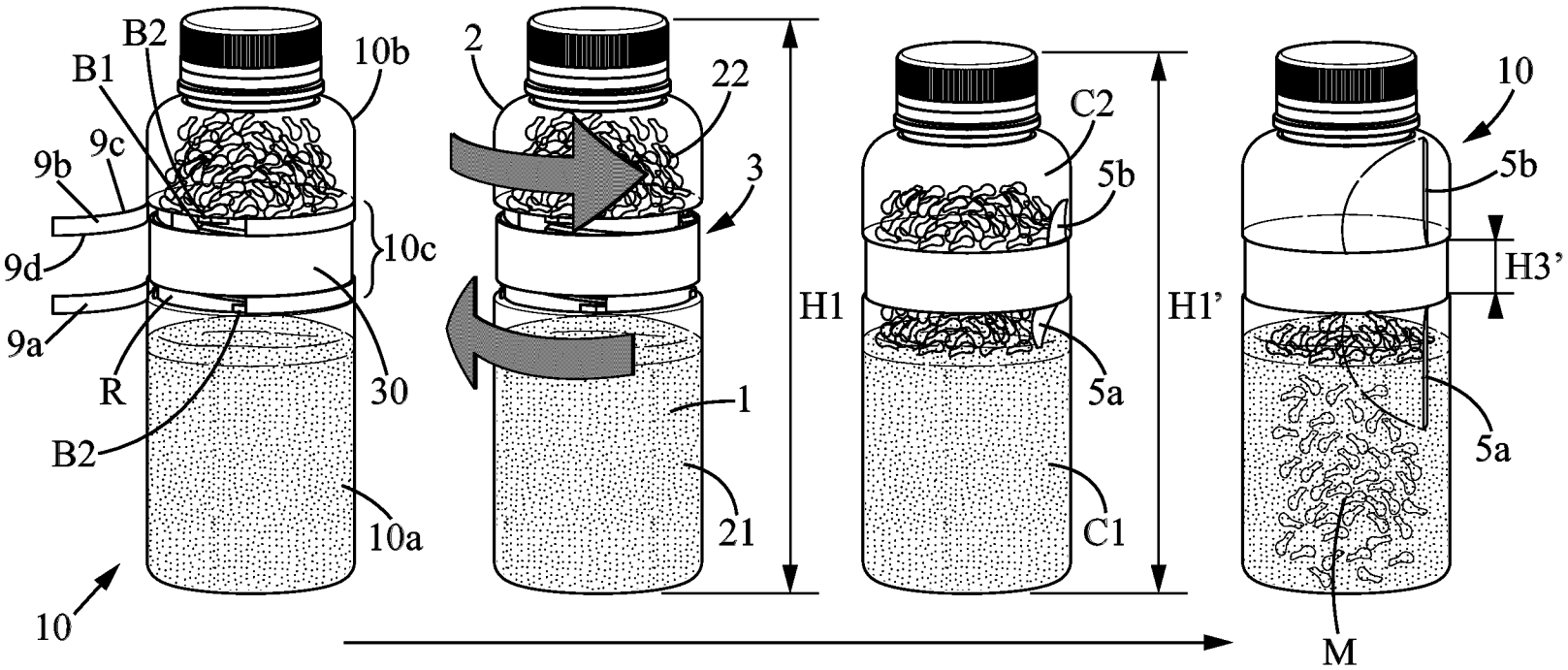
FIG. 8 shows four containers at respective states of use by the consumer, before shaking and removing the cap, in order to illustrate a way of activating mixing of the contents that are initially separated by two membranes distributed in two different packaging units.

Referring to FIGS. 1 and 8, the outer sidewall (10*a*, 10*b*, 10*c*) may delimit an interior volume that may be composed of the two compartments C1, C2 and an internal passage 4 intermediate between the compartments C1, C2. The first compartment C1, the internal passage and the second compartment C2 may be complementary sub-volumes of the interior volume of the container 10. The container 10 has an opening O1 typically used to directly drink or eat a mixture of contents 21, 22 distributed in the respective compartments C1, C2. To prevent the mixing in a storage condition of the container 10, a first closure member 15*a* is sealing the compartment C1 and a second closure 15*b* is sealing the compartment C2, so that the closure members 15*a*, 15*b* act as partitioning walls of the whole interior volume of the container 10.

The interface device 3 and the container bodies 1, 2, are designed as separate pieces and the interface device 3 may be of smaller axial size or height than the container bodies 1, 2. The split between the respective volumes of the first compartment C1 formed by the first container body 1 and the second compartment C2 formed by the container body 2 may go from 5-95% to 95-5%. The separation between the first compartment C1 and the second compartment C2 may be provided at the interface device 3, which can form a single intermediate compartment (not initially filed with content). Indeed, the internal passage 4 sealed between two respective closure members 15*a*, 15*b* may be provided in the inner volume surrounded by the interface device 3 and such internal passage 4 can directly communicate with the first compartment C1 and the second compartment C2 when the container bodies 1, 2 are open.

The closure member 15*a* can thus be in contact with a first content 21 stored in the first compartment C1, as long as the closure member 15*a* is sealing the internal passage 4. Similarly, the closure member 15*b* can be in contact with and directly support a first content 22 stored in the first compartment C2, as long as the closure member 15*b* is sealing the internal passage 4. Each content 21, 22 may be wet or dry, solid or liquid or mix of the two.

Figure 2:
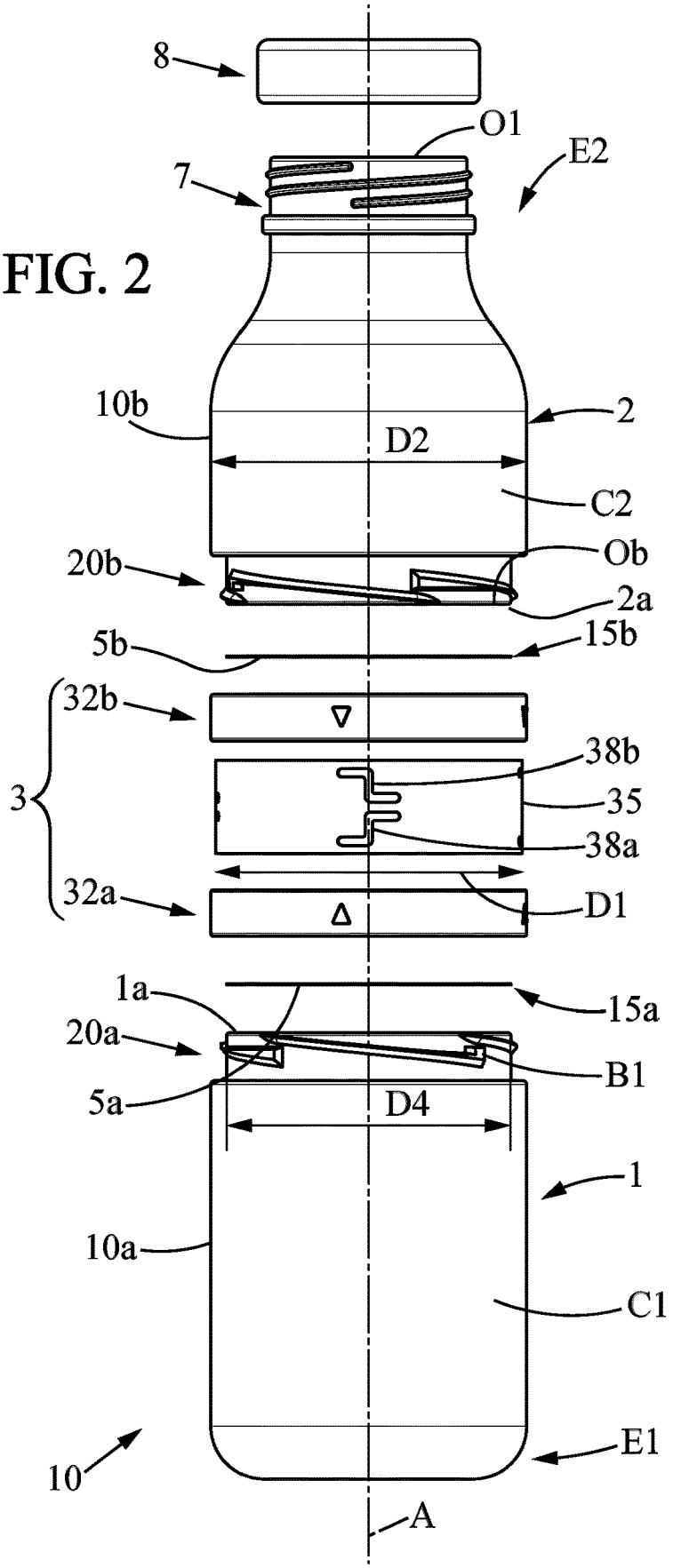
FIG. 2 is an exploded parts illustration of the container of FIG. 1.
Figure 5:
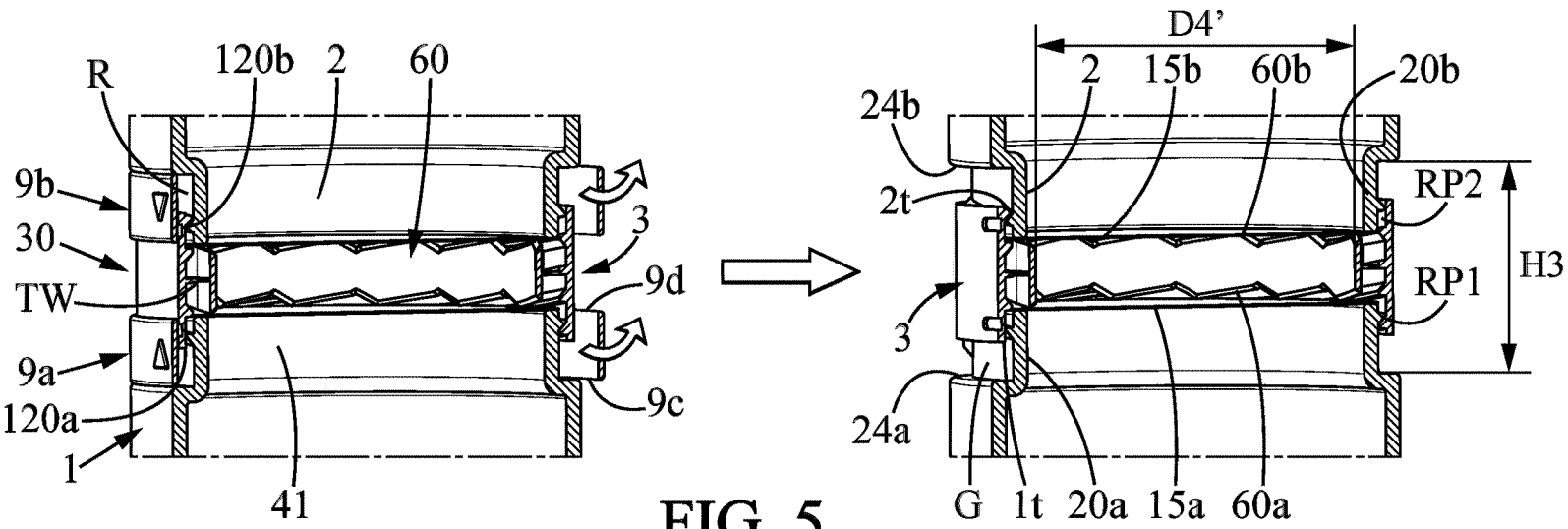
FIG. 5 illustrates another way to obtain an unprotected position, using a pair of tamper-evidence bands that can be torn.

Referring to FIGS. 2, 5 and 8, the internal passage 4 may have a diameter D4' that is more than half of maximal radial size, here a maximal diameter D2 of the container 10. This diameter D4' may be slightly inferior to diameter D4 of the respective openings Oa, Ob of the container bodies 1, 2, included in the couplers 20*a*, 20*b* or similar annular coupling parts of the container bodies 1, 2. More generally, the internal passage 4 may be of greater size than the opening O1 of the container 10 and/or sufficiently wide so as to not restrict the flow of the mix M when pouring it through the opening O1.

Referring to FIGS. 1-3 and 8, the interface device 3 forms a part that can extend substantially in the middle of the container 10, so as to form an intermediate wall section 10*c* (see FIG. 8), away from the opening O1 and the bottom B, extending substantially in the middle of the container side wall (10*a*, 10*b*, 10*c*). The interface device 3 is provided with rigid outer parts, preferably made of plastic material, to define the intermediate wall section. The interface device 3 here comprises only one connector 30, of annular shape and engaged with the container bodies 1, 2 to provide a fluid tight connection between the first compartment C1 and the second compartment C2 when the internal passage 4 is released.

Details of the Container Structure and of the Inner Closure Members in Exemplary Embodiments The container 10 is provided with two opposite ends E1, E2. FIG. 1 shows a container lower end or base included in the first container body 1 and provided with a bottom B having a bearing surface (here a closed bottom) for contact on a planar surface, on shelves or any similar support. The container 10 also has an upper open end formed by a mouth of the second container body 2. However, it is understood that the container 10 can also be provided with additional separate parts to define the opposite ends E1, E2. Typically, the container 10 generally includes a lid or cover or cap 8 to seal the mouth formed at the opening O1. The cap 8 may be removable to pour the mix M. Alternatively, the cap 8 may be kept fixed to the container body 2 and provided with a valve or a subpart forming a pouring nozzle.

The end E2 is provided with such opening O1 and may form a top end E2 axially opposite the end E1 provided with the bottom B. A neck 7 or similar pouring part may be connected at an end of the container side wall (10*a*, 10*b*, 10*c*), preferably at the side wall section 10*b* surrounding the second compartment C2. The container 10 is preferably closed by a cap 8 that is releasably mated (e.g., threadingly secured) to the neck 7 of the second container body 2. Alternatively, the sealing of the opening O1 is performed by a non-repositionable flexible or rigid lid, possibly provided with a pull element such as a pull tab. Besides, the opening O1 is not necessarily provided at an end E2 of narrower size as compared to the other end E1. In some variants, the lid or cap 8 may cover a relatively wide end E1. A flange portion may optionally surround a wide opening formed at the end E1 and/or the container 10 may be provided without any neck or thread.

The construction illustrated in FIG. 1 may be preferred to limit the number of pieces to be assembled when producing the container 10. For instance, a packaging with two compartments C1, C2 can be obtained after operatively coupling the first container body 1 and the second container body 2 by using the interface device 3 as intermediate connecting means. A mixing mechanism can be selectively included in the interface device 3, which comprises means for releasing an internal passage 4, allowing communication between the first compartment C1 and the second compartment C2.

A longitudinal axis A may form a common central axis for the three main parts of the container 10, as the first container body 1, the second container body and the interface device 3 typically have a similar tubular side wall section. For a compact construction and ease of mixing between the ingredients initially separated in the respective compartments C1, C2, the internal passage 4 advantageously extends centrally around the longitudinal axis A and, optionally, may be at least as wide as the opening O1 of the container 10. In some variants, the internal passage 4 may be common to more than two chambers/compartments, for instance when a partitioning wall is provided in an inner volume of the first container body 1 and/or in the inner volume of the second container body 2.

Alternatively or additionally, the internal passage 4 may be laterally shifted with respect to a central axis of the container 10. Besides, the outer shape of the container sidewall may be bent so that the interface device 3 and/or the internal passage 4 may be provided at intersection of two distinct axes (one for the first container body 1, the other one for the second container body 2). It is thus understood that the geometry, shape and size of the container 10 can vary, the detailed exemplary design of the interface device 3 shown in the drawings being only provided for illustration.

The opening O1 may be circular and provided with a diameter comprised between 18 mm and 36 mm, which is advantageous compromise for fast filling of the content 22 in the second compartment C2 and for appropriate pouring of the mix M, once the container 10 has been activated.

Referring to FIGS. 1-3, 7 and 9-10, the closure members 15*a*, 15*b* may be partly or entirely flexible and they typically are inner closure members, without any part able to be actuated from outside the container outer sidewall. Here, each closure member 15*a*, 15*b* may include a membrane 5*a*, 5*b*. The membranes 5*a*, 5*b* directly adhere each to the first and second couplers 20*a*, 20*b* respectively at a rim 1*r*, 2*r* of such coupler 20*a*, 20*b*, preferably with a chemical bond in thermoplastic material from the membrane 5*a*, 5*b* and from the coupler 20*a* or 20*b*.

Optionally, the membrane 5*a* sealing the first compartment C1 is typically sized as the annular rim 1*r* or flange surrounding the opening Oa of the first container body 1, here with same outer shape. At least the closing portion 5*c* of the closure membrane 5*a* is formed by a multilayer structure. The same optionally applies for the other closure membrane 5*b* sealing the second compartment C2.

More generally, each closure member 15*a*, 15*b* is provided with a flexible or semi rigid membrane 5*a*, 5*b*, preferably of substantially circular section, having at least one portion which is piercable or otherwise rupturable. Such membranes 5*a*, 5*b* form an intercompartment membrane assembly since it separates the respective contents 21 and 22 as long as they seal the internal passage 4.

Such membrane 5*a*, 5*b* here defines the closure member 15*a*, 15*b*, respectively and generally has a thickness between 0.01 and 1.0 mm, more typically between 0.05 and 0.1 mm, and can be made for instance, but not limited to, from a film-forming polymer, a plastic polymer, a metal such as aluminum, or combinations thereof, such as a plastic coated aluminum sealing membrane or a lacquer coated aluminum sealing membrane.

Figure 10:
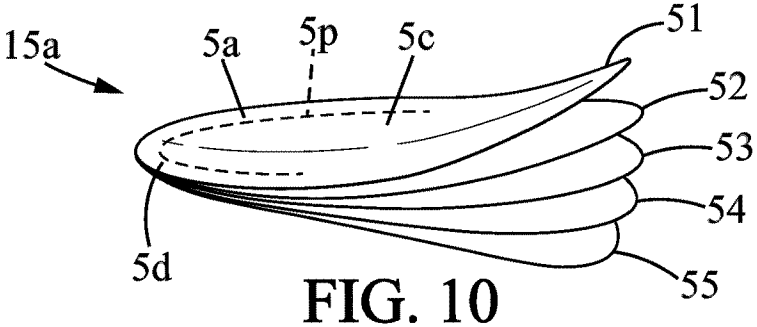
FIG. 10 illustrates an example embodiment of the closure member used to initially separate one of the compartments of the container and an intercompartment internal passage delimited by the connector.

As illustrated in FIG. 10, any one of the membrane 5*a*, 5*b* may be composed of at least two or three layers. In some embodiment compatible with induction sealing, preferably four or five layers 51, 52, 53, 54, 55 are provided. The membrane 5*a*, 5*b* is preferably opaque. While the illustrated embodiment shows an internal layer that is an electrically conducting layer, here aluminum foil 53 or other similar metal foil, other structures may be chosen for a sealing effect. Typically, the two outer layers 51, 55 are heat sealable. Alternatively, only one of the outer layers 51, 55 is heat sealable and may optionally be directly attached to the first container body 1, at the rim 1*r* shown in FIG. 7, or to the second container body 2, at the annular rim 2*r*. Options using a combination of superimposed membranes or similar elements may be used to close the internal passage 4 and allow air-tight attachment to a flange or rim 1*r*, 2*r* of the container body.

Each outer layer 51, 55 may be of Polyethylene or Ethylene Vinyl Acetate Copolymer, for instance. The tensile strength of the membrane 5*a*, 5*b* is typically inferior to 300 Newton, typically inferior or equal to 100 or 200 Newton, preferably inferior to 50 Newton, and/or has a weakening zone along the longitudinal projection of the free edge of the puncturing structure 6 (at least the area intended to be engaged by the corresponding piercing member or similar opening means 60*a*, 60*b*, respectively).

The membrane 5*a*, 5*b* is sufficiently flexible as to allow that, after the piercing of the membrane 5*a*, 5*b* or a pushing, it can be folded by the puncturing structure 6 towards the circumferential wall of the corresponding container body 1, 2.

Figure 9:
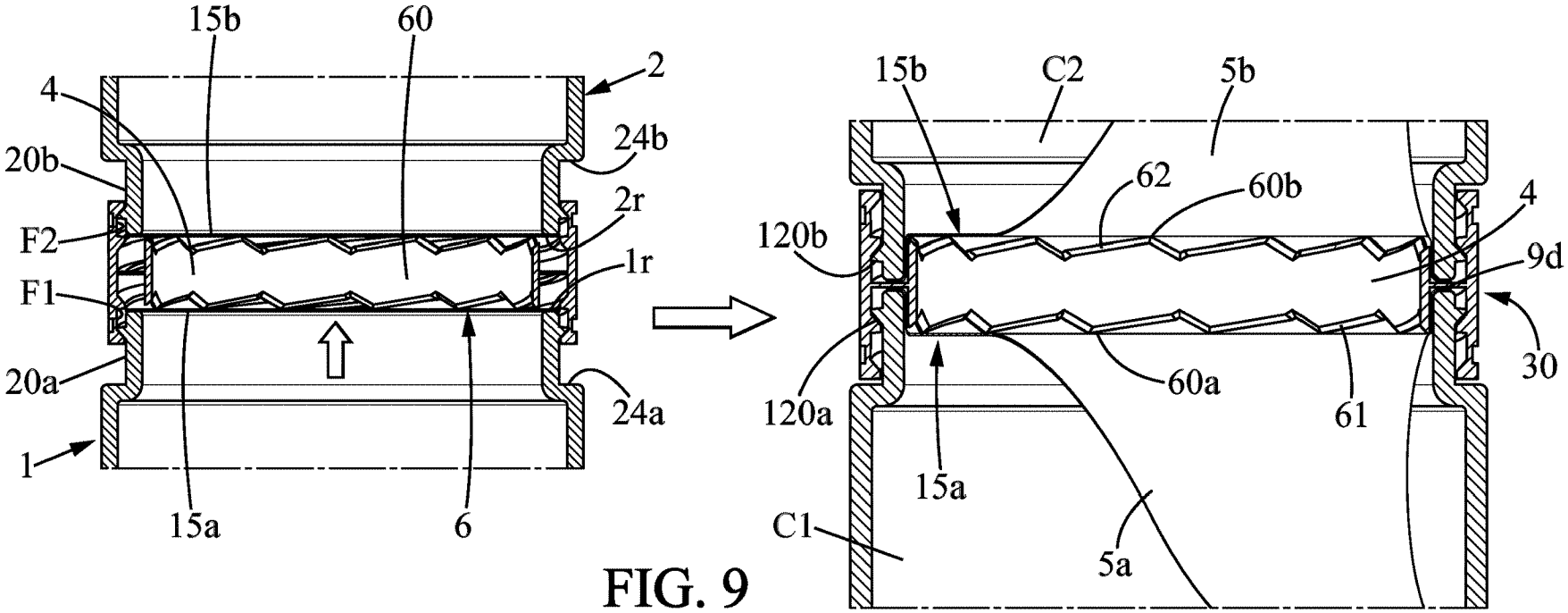
FIG. 9 illustrates relative displacement of the connector relative to the packaging units, when piercing two membranes to release an internal passage, and thus allowing mixing of the contents.

A PET layer 54, used as an intermediary layer between the aluminum foil 53 or similar metal foil and an outer layer 51, 55 may be provided to increase strength of the membrane 5*a*, 5*b*. Optionally, a layer 52 made of EPE (Expanded Polyethylene) may be used as an intermediary layer between the aluminum foil 53, similar metal foil and an outer layer 51, 55. In FIG. 9, the layer 53 is sandwiched between the layers 52 and 54. In some options, the layer 53 and/or another intermediate layer 52 or 54 is removed.

Referring to FIG. 9, each membrane 5*a*, 5*b* has a margin portion 5*d* of annular shape in contact with an annular rim 1*r*, 2*r*, respectively, and may be pierced along a partially circumferential piercing path, whereby a connection is maintained between the pierced membrane and a circumferential/annular rim 1*r*, 2*r* onto which an annular margin portion 5*d* is attached, through a non-pierced segment of the membrane 5*a*, 5*b*. As illustrated in FIG. 10, a frangible/fragile or pre-cut line 5*p* may be provided in at least one of the membranes 5*a*, 5*b*, thus facilitating rupturing the membrane material, at such line 5*p* separating the closing portion 5*c* of the membrane 5*a*, 5*b* from the margin portion 5*d*. With such arrangement, the edge of the structure 6 can be provided without any teeth or sharp edges and/or accidental loss of membrane material is easily prevented.

Referring to FIG. 8, the first container body 1 is provided with the first compartment C1 for containing a first content 21, while the second container body 2 is provided with a second compartment C2 for containing a second content 22 that is typically of different nature, texture, or any different aspect from the first content 21.

In the example of FIGS. 1 and 9, it can be seen that the closure member 15*a* extends, preferably planarly, between the planar top face at the annular rim 1*r*, included in the annular end 1*a* of the first container body 1, and a connector 30 of the interface device 3. Similarly, the closure member 15*b* extends, preferably planarly, between the planar lower face included in the annular rim 2*r*, included in the annular end 2*a* of the second container body 2, and the connector 30 of the interface device 3.

In a ready-to be actuated configuration, the connector 30 is tubular and longitudinally extends around its longitudinal axis A, which may optionally be a central axis of the multiple compartment container 10. The connector 30 comprises a first ring part RP1 and a second ring part RP2, which may define all or part of the outer wall section 10*c*. In an activated configuration of the container 10, the ring parts RP1, RP2 form a tubular wall 35 of the connector 30 and belong to a same rigid piece of plastic material. The connector 30 typically has the tubular wall 35 delimiting an exterior face of the interface device 3, as illustrated in FIGS. 2-3 in particular.

Figure 3:
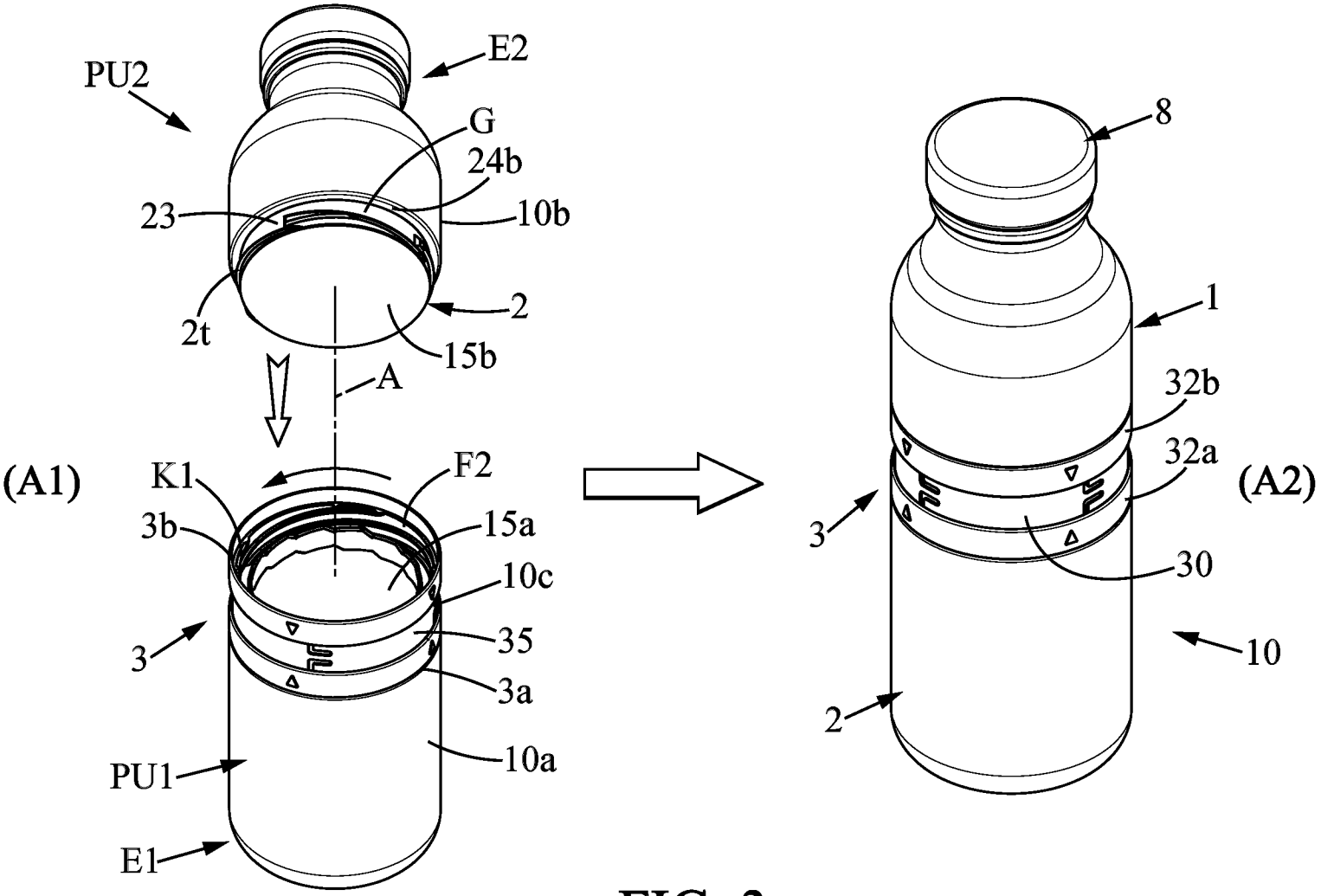
FIG. 3 illustrates an example step for finalizing assembling of the container of FIGS. 1-2, the interface device being either used for the first time or re-used.
Figure 4:
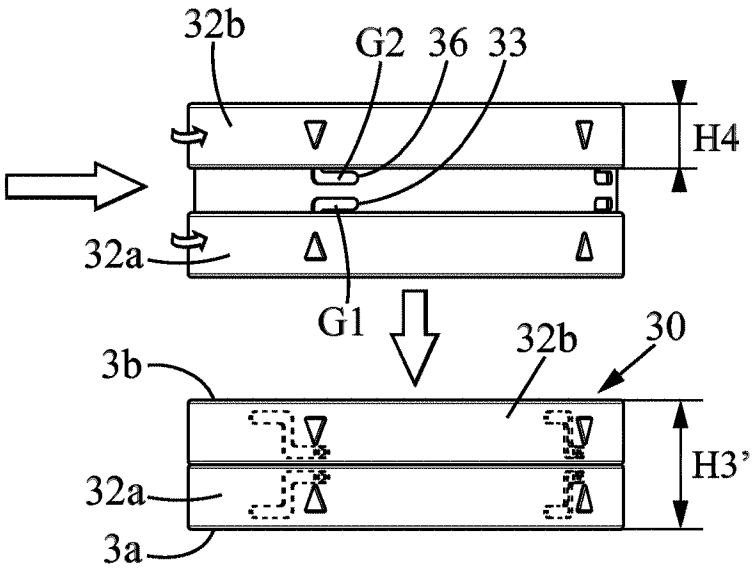
FIG. 4 illustrates an option to displace respective protection rings of the interface device, from a protecting position to prevent any twist action, to an unprotected position.
Figure 4:
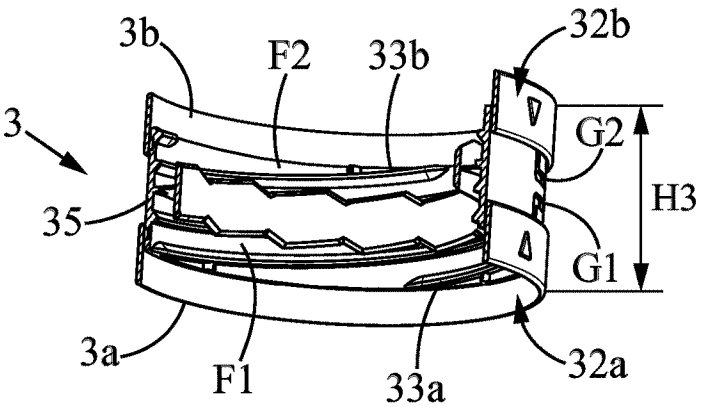

Referring to FIGS. 2-5, the connector 30 also includes at least one transverse wall portion TW that extends inside the interior volume of the container 10. The transverse wall portion TW protrudes inwardly from the tubular wall 35, at an intermediate position between a first inner face F1 included in the first ring part RP1 and a second inner face F2 included in the second ring part RP2. As illustrated in FIGS. 3-5, the first inner face F1 is adapted to guide movement of a first coupler 20*a* here arranged as a neck of the first container body 1. Similarly, the second inner face F2 is adapted to guide movement of a second coupler 20*b* here arranged as an inverted neck of the second container body 2, at the opposite from the opening O1. The respective couplers 20*a*, 20*b* may form the annular ends 1*a*, 2*a*, which are mutually facing each other in the example of FIG. 1.

A puncturing structure 6 having two series of teeth, as illustrated in FIG. 9, or any similar structure forming two opening means 60*a*, 60*b* can be provided in the connector 30. While a number of teeth or piercing members comprised between 5 and 20, preferably between 7 and 15, is shown in embodiments of Figs, it is understood that the design of the puncturing structure 6 may vary to permit releasing of the internal passage 4.

Figure 14A:
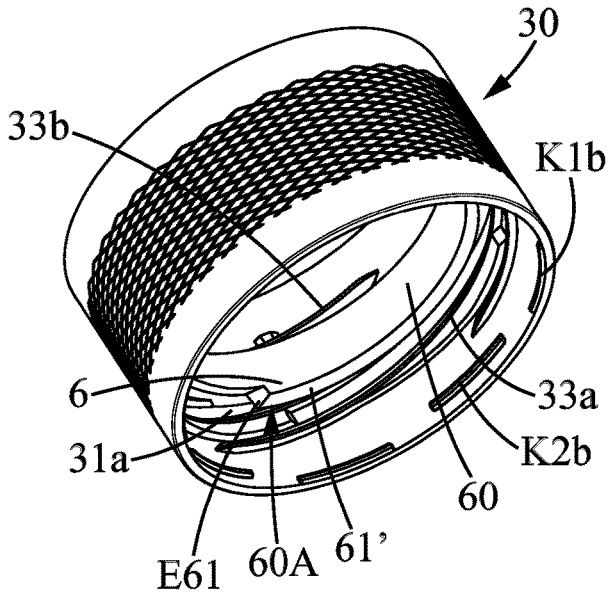
FIG. 14A is a perspective view showing a generally rigid connector of the interface device, provided with two opposite cutting blades, one of the cutting blades having a bevel edge for contact with a membrane, with helicoidal configuration, a side bevel adjacent to a lowermost end of the helical edge being provided at a leading end of the cutting blade.

Referring to FIG. 14A, an edge 61' with a slant may be provided in the puncturing structure 6. In a transition region of this structure 6, a cutting angle may be formed, at a leading end of the generally helical cutting edge 61'.

The puncturing structure is integral with the transverse wall portion TW, which transversally extends between the inner guiding surface of the tubular wall 35 and an outer surface (typically a smooth surface) of the puncturing structure 6. This structure 6 is arranged here cylindrically. The structure 6 may be a rigid cylindrical part 60, forming a cylindrical wall provided with opposite edges 61, 62, each having at least one part provided with reliefs that are either wavy in regular manner or provided with an irregular shape, typically with sharp angles (significantly different from the flat angle of 180°). Here, two series of teeth orientated in opposite axial directions are included in the cylindrical wall, as axial protrusions, to respectively constitute the first opening means able to pierce the membrane 5*a* of a first closure member 15*a* sealing the first compartment C1, and the second openings means 60*b* able to pierce the membrane 5*b* of the second closure member 15*b* sealing the second compartment C2. The annular shape of the cylindrical wall or part 60 is of interest to have a relatively wide section for the internal passage 4 that is here delimited by this cylindrical part 60. Such passage 4 is also delimited, typically axially, by the closure members 15*a*, 15*b* before displacement of the couplers 20*a*, 20*b* toward the transverse wall portion TW. Such passage 4 can be axially shorter to be substantially as high as the thickness of the wall portion TW. Preferably, the internal passage 4 is wider than high (with height measured along longitudinal axis A), to provide compactness of the container 10.

While the illustrated embodiments show first opening means 60*a* and second opening means 60*b*, which are included in a same plastic part (or other suitable part of rigid material) that is a cylindrical part 60 of the connector 30, here arranged coaxially inside the tubular wall 35, cross-section geometry of a different type may be used to delimit the internal passage 4. Also the connector 30 could be provided with a longitudinal partition, for instance to strengthening the connector 30, so that the internal passage 4 could be split in two or more/several separate passages.

The cylindrical wall or part 60 is here a rigid part of the connector 30, configured to partly extend within an open part (i.e. the coupler 20*a* or neck) of the first container body 1 and within an open part (i.e. the coupler 20*b* or neck) of the second container body 2, simultaneously, in a second configuration of the container 10, which is an activated configuration for mixing the contents 21 and 22.

Details about the Connector and the Openings Means Included in the Interface Device In embodiments as or similar to FIGS. 1-2, the connector 30 is a one piece plastic element of annular shape maintaining an alignment between the two container bodies 1, 2, so that each of these elements is coaxially arranged around the longitudinal axis A. Of course, the connector 30 may have another geometry in other embodiments, for instance with a bent shape or a deviation between the ring parts RP1, RP2. The ring parts RP1 and RP2 of the connector 30 are preferably female parts, so that the couplers 20*a*, 20*b* may penetrate the inner volume of the connector 30. Besides the connector 30 may be an assembly of several pieces, for instance two pieces directly interconnected, in some variants. The connector 30 is washable.

Figure 6A:
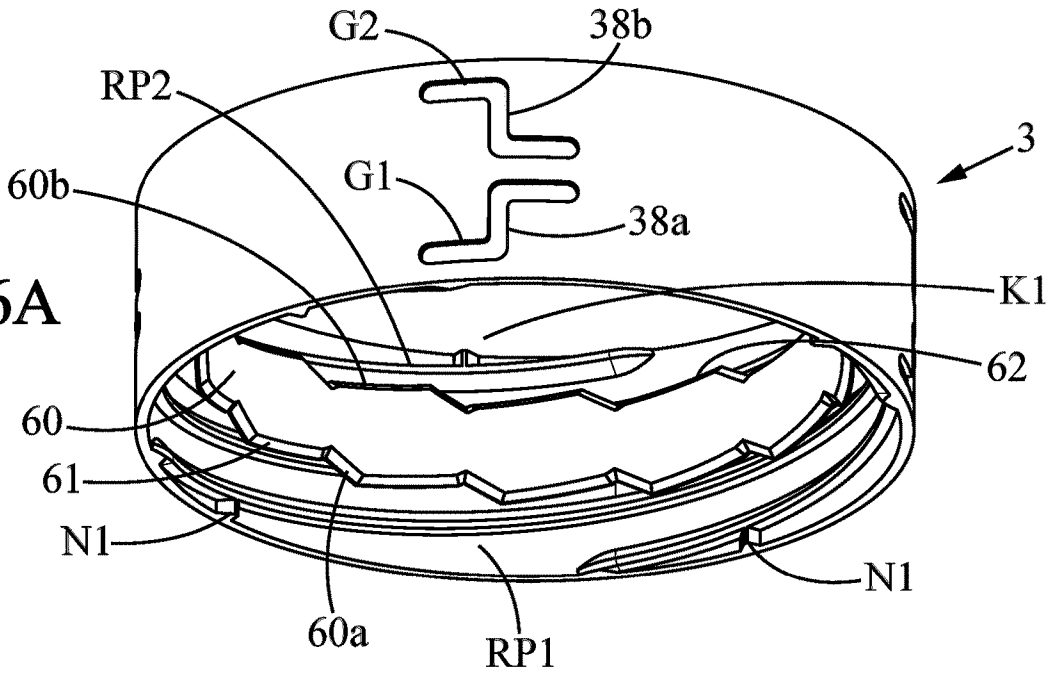
FIG. 6A is a perspective view showing a rigid connector of the interface device, provided with two opposite ring parts for contact/fastening with the container bodies, and with a middle part providing two respective opening means able to remove sealing membranes.
Figure 6B:
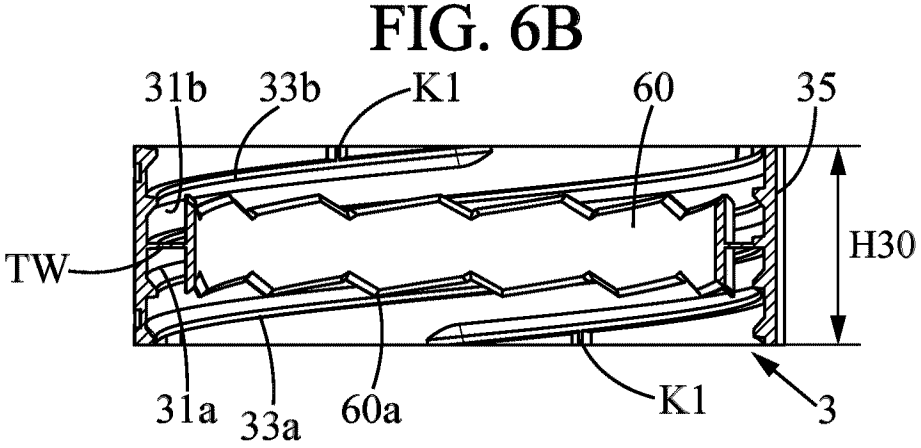
FIG. 6B a cut-away view showing a connector similar to the connector of FIG. 6A, except for some retaining features, such connector being adapted to indifferently form an interface device as in FIG. 4 or as in FIG. 5.

As shown in FIG. 6A-6B or 14A, the connector 30 includes two cutting edges 61, 62, 61' that are shifted radially inwards relative to the tubular outer wall 35. Inwardly orientated bevels may be provided to form the cutting edges 61, 62, 61'.

It is understood that the connector 30 may be removably fastened to each container body 1, 2, as the couplers 20*a*, 20*b* are able to be engaged and disengaged as male parts, the couplers 20*a*, 20*b* being typically couplers rotated relative to the connector 30. As described below in greater detail, the couplers 20*a*, 20*b* allow actuating the activated configuration of the container 10 by rotating the container bodies 1, 2, possibly simultaneously but with contrary rotation directions (twist movement). More generally, it of interest to provide a connector 30 that may be re-used.

Now referring to FIGS. 3-5, the connector 30 is preferably suitable for allowing insertion of the couplers 20*a*, 20*b* in the inner volume/space of the connector 30, but in an exterior periphery of the structure provided with the opening means 60*a*, 60*b*. The insertion of the couplers 20*a*, 20*b* may be controlled thanks to guide elements regularly distributed on inner circumference of the respective ring parts RP1, RP2, on face F1 and on face F2 respectively. The guide elements may comprise or consist in one or more threads 33*a*, 33*b*. In such case, each fastening surface 120*a*, 120*b* in the couplers 20*a*, 20*b* has at least one complementary thread 1*t*, 2*t*.

More generally, the interface device 3 may be configured in various ways, preferably allowing a twist action which enables a relative rotary and vertical motion between teeth, piercing member or similar opening means 60*a*, 60*b* and the closure members 15*a*, 15*b*. For allowing a twist movement when actuating the activated position, the coupling means may be provided with one or more helical reliefs or threads, or formed as recesses in thickness of the ring parts RP1, RP2, in order to guide complementary lugs of the couplers 20*a*, 20*b*. It is understood that the interface device 3 may be provided with any kind of helical cam engaging with one or more guide elements, so that the coupler 20*a*, 20*b* is movable in translation combined with rotation, relative to the connector 30.

The opening means 60*a*, 60*b* may be edges 61, 62 included in the connector 30 or any suitable part of the interface device integral with the connector 30/not following movement of the container bodies 1, 2 when activating the opening of the compartments C1, C2. An intermediate compartment C3 (see FIG. 1), which is typically empty or possibly filled with a solid product or object, extend between the closure members 15*a*, 15*b* and is thus interposed between the compartments C1, C2.

Figure 7:
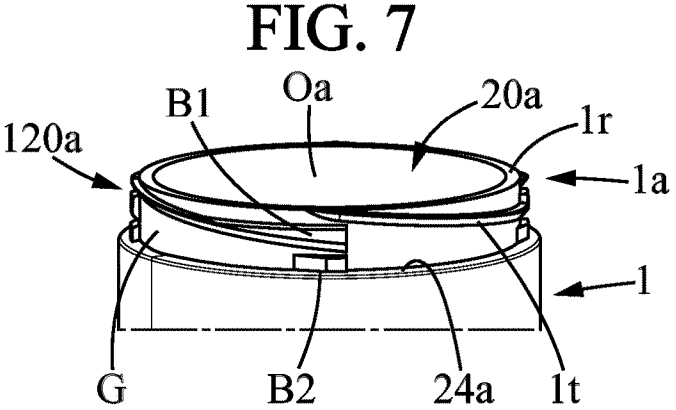
FIG. 7 illustrates an example coupler provided at an annular part of a container body, such coupler being adapted to form a male coupler engaged with a ring part of the connector such as shown in FIG. 6A or 6B.

Referring to FIGS. 5 and 7, the first container body 1 has a first coupler 20*a*, here corresponding to a neck, provided with an outer fastening surface 120*a* configured to be rotatably engaged on the first ring part RP1 of the connector 30, while the inverted neck or similar second coupler 20*b* in the second container body 2 is provided with an outer fastening 120*b* surface configured to be rotatably engaged on the second ring part RP2. Each fastening surface 120*a*, 120*b* extends annularly around the longitudinal axis A and defines an annular groove area G, axially delimited:

between a body shoulder 24*a* and one or several outer threads 1*t*, for the first coupler 20*a;* between a body shoulder 24*b* and one or several outer threads 2*t*, for the second coupler 20*b;*

The couplers 20*a*, 20*b* can be pushed and/or screwed to have their outer threads 1*t*, 2*t* penetrating inside the tubular wall 35 of the connector 30, beyond some retaining inner reliefs K1, N1 of the ring parts RP1, RP2, such inner reliefs being axially close or adjacent to the annular rim 1*r*, 2*r* of the container body 1, 2. The couplers 20*a*, 20*b* are movable/insertable only in a region radially offset outward relative to the piercing members/teeth or pushing edges used to open the compartments C1, C2. Such insertion is obtained with an intermediate locking by the inner reliefs K1, N1, in order to:

make each coupler 20*a*, 20*b* easy to be inserted/fitted along an inner face F1, F2 of the ring parts RP1, RP2, respectively, with a guiding effect, typically by threads 33*a*, 33*b* provided in the ring parts RP1, RP2 (see FIGS. 3-4 and 6A-6B);

prevent accidental removal of the container bodies 1, 2 after obtaining the state (A2) as illustrated on the right in FIG. 3; and prevent accidental activation of the mixing.

Such positioning of the couplers 20*a*, 20*b* is also of interest as they are already centered and ready to entirely overlap (from the inside) the threads 33*a*, 33*b* in the activated configuration where liquid can flow in the internal passage 4.

For having an intermediate locking, it can be seen in FIGS. 3 and 6A-6B that the connector 30 comprises at least one abutment or retaining element K1, N1, optionally formed in an inner face of the ring part RP1, RP2 and configured to:

engage with an abutment element B1 or detent element integral with the first coupler 20*a*, as far the coupling of the first coupler 20*a* is concerned, engage with an abutment element 23 integral with the second coupler 20*b*, as far the coupling of the second coupler 20*b* is concerned.

Such arrangement prevents the container bodies 1, 2 from being accidentally detached from the connector 30. One or more retaining elements K1, N1 may be formed by the one or more guide elements or threads 33*a*, 33*b* of the connector 30. FIG. 6A shows a notch N1 or similar detent element to provisionally prevent rotation of coupler engaged in the ring part (here ring part RP1) of the connector 30.

FIG. 6B illustrates use of retaining elements K1 acting as detent elements. The threads 1*t*, 2*t* or other guide elements of the coupler 20*a*, 20*b* may be configured to engage in one way through such detent element K1, so that the threads 1*t*, 2*t* or other guide elements penetrate the groove region G. The retaining element K1 is here provided in an axial connector mouth, on each inner face F1, F2.

FIG. 6B illustrates retaining elements K1 that can act as detent elements to keep each thread 1*t* or 2*t* in a predetermined angular sector also limited by a maximum insertion stroke. When using threads 1*t*, 2*t*, the maximum insertion stroke of the couplers 20*a*, 20*b* is limited by the transverse wall TW of the connector 30 and/or by reliefs or stoppers, such as an abutment element B2 as illustrated in FIG. 7, which is close or adjacent to a shoulder 24*a* or 24*b*, respectively.

More generally, such abutment element B2 or any detent member can be provided in at least one of the couplers 20*a*, 20*b*, in order to rotationally lock at least one of the container bodies 1, 2 relative to the connector 30, in the second/activated configuration. In some options, the shoulders 24*a*, 24*b* may be directly used to form an abutment face preventing further twisting or similar movement for further insertion of the couplers 20*a*, 20*b*. Any other kind of mechanical stopper for preventing any further insertion in the connector 30 may be provided, in some variants.

The abutment elements B1, 23 may be identical and, also, the couplers 20*a*, 20*b* may be identical but distributed one in the neck of the first container body 1 and the other one in the neck (inverted neck when assembled) of the second container body 2.

The annular groove area G may allow a rotation of about 90° or similar angle inferior to 100°, in order to allow a locking by rotation immediately following a deeper insertion of the coupler 20*a* or 20*b* inside the connector 30. For compactness of the container 10, the cumulated height of the two couplers 20*a*, 20*b* is substantially equal to height H30 of the tubular wall 35 of connector 30. Such height H30 being also preferably the height of the connector 30 as the structure with the opening means here extends entirely inside the inner volume delimited by the tubular wall 35. In some variants, some protecting rings 32*a*, 32*b* may be provided to enhance this protective effect and/or increase outer height of the re-usable part of the interface device 3. More generally, the interface device 3 is provided with a tubular outer wall, which prevents any part of the opening means 60*a*, 60*b* to protrude axially outward, which is user-friendly for facilitating re-use of the connector 30 and handle it by a user's hand. Referring to FIG. 3-4, 6A-6B or 11, it is clearly apparent that the connector 30 or similar re-usable part of the interface device 3 may be deprived from axial protrusions and/or from any sharp angles or teeth in any peripheral/outer part thereof.

Now referring to FIGS. 1 and 5, it can be seen that the transverse wall portion TW is inwardly connected to the tubular structure with opening means 60*a*, 60*b*, here a cylindrical part 60, so that in assembled state of the container 10, the transverse wall portion TW allows spaces or housing 31*a*, 31*b* to be delimited between the tubular wall 35 and the inwardly shifted part 60. More generally, the interface device 3 comprises a first housing 31*a* and a second housing 31*b* each of annular shape and delimited inwardly by an outer periphery of the cylindrical part, the cylindrical part 60 having an inner face that delimits the internal passage 4.

In the first configuration of the container 10, which may be provisionally locked as illustrated in FIGS. 1 and 5, only a part of the threads t1, t2 extend inside the connector 30, in the housings 31*a*, 31*b*. Referring to non-limiting embodiments of FIGS. 7-8, it can be seen that the optional abutment part B2 at an end of thread 1*t* or 2*t* can extend entirely outside the connector 30 in the first configuration, and the abutment element B1 can extend substantially inside the inner volume of the connector 30. In this configuration, a detent or locking member K1 protruding from the outer face of the neck of the container body 1 or 2 can be present at the rear of the abutment element B1, so that reverse twisting is prevented. Such member K1 is beveled to facilitate insertion of the couplers 20*a*, 20*b*. At the end of the relative rotation between a container body 1, 2 and the connector 30, the member K1 will form a locking member for another separate thread 1*t* or 2*t*. The same applies when the connector is provided with one or more notches N1 able to lock position of a coupler 20*a* or 20*b*.

More generally, the assembly with the couplers 20*a*, 20*b* can typically include stops/stoppers. Thread stops or members forming clips may be preferred for assembly & activation feedback (a sound can be heard when the locking is obtained).

Specific teeth, piercing members or similar opening means 60*a* designed to punch and cut a corresponding membrane 5*a* are provided on a first part or edge 61 of a first free end. Such first edge 61 may include a continuous or discontinuous row of teeth designed to pierce and cut the membrane 5*a* and then folding the cut membrane 5*a* out of the way (the internal passage 4 being essentially free of any packaging material thanks to such folding, the first edge 61 typically representing at least one half of the circumference of a first free end of the cylindrical part 60 and being typically rotated of angle of about 10-90° or more). The same may optionally apply for the other opening means 60*b*, provided in a second edge 62 that can include a continuous or discontinuous row of teeth designed to pierce and cut the membrane 5*b* and then folding the cut membrane 5*b* out of the way (the first edge 62 typically representing at least one half of the circumference of a second free end of the cylindrical part 60 and being typically rotated of angle of about 10-90° or more).

Referring to FIGS. 4-5 and 9, in the first/inactivated position, the puncturing structure 6 provided with a plurality of piercing members/teeth is in an initial distal position, possibly axially spaced from less than 4 or 5 mm, with respect to the membrane 5*a* of the closure member 15*a*. Once both main components are fully twisted, the membrane 5*a* of the closure member 15*a* is pushed down through the coupler 20*a* and the membrane 5*b* of the closure member 15*b* is pushed up through the coupler 20*b* to allow the second content 22 contained in the second compartment C2 to fall down.

In the second configuration, the annular end 1*a* of the first container body 1 extends inside the first housing 31*a*, so that the coupler 20*a* can be hidden inside the connector 30, the same possibly applying for the annular end 2*a* of the second container body 2, extending inside the second housing 31*b* so that the coupler 20*b* can be hidden inside the connector 30.

Referring to FIG. 8, it can be seen such movement causes a reduction in height, since initial height H1 in the first configuration of the container 10 is reduced after the twisting. The interface device 3 may be differently constructed to permit such reduction in height, for instance either with reduction of initial height H3 of a rigid interface device 3 and screwing of the container bodies 1, 2 inside a connector 30, or just by moving the container bodies 1, 2 relative to a rigid connector 30 of the interface device (with the rigid connector being the single rigid part/piece of the interface device 3).

Details of a First Particular Embodiment of an Interface Device

In a first embodiment as illustrated in FIGS. 1-4, the two opposite axial ends 3*a*, 3*b* of the interface device 3 are spaced to define a maximal height H3 (see FIG. 4) of the interface device 3, while in the second configuration, the two opposite axial ends 3*a*, 3*b* of the interface device 3 are spaced to define a lower height H3' of the interface device 3. Here, the interface device 3 has two protecting rings 32*a*, 32*b* surrounding the piece forming the connector 30. The two protecting rings 32*a*, 32*b* are fastened to the outer face of the tubular wall 35 and are movable relative to the connector 30, with a displacement determined by a design of tracks or grooves G1, G2 (see also FIG. 6A) formed externally on the tubular wall 35. The connector 30 is provided with two series of outer guiding grooves:

- a first group of outer grooves G1, in order to successively rotate, axially slide, and further rotate the first protecting ring 32*a;*
- a second group of outer groves G2 in order to successively rotate, axially slide, and further rotate the second protecting ring 32*b*.

The axial sliding in the groove is permitted by two longitudinal sections 38*a*, 38*b* that may optionally be in alignment. More generally, the grooves G1, G2 are double bent, optionally with a pair of angles each of about 90°. Each protecting ring 32*a*, 32*b* has a height H4 lower or substantially equal to half the height of the connector 30. It is of interest to have such protecting rings 32*a*, 32*b* not interfering with insertion movement of the container bodies 1, 2. The end part 33 of the groove G1 and the end part 36 of the groove G2 may be parallel, proximal and separate by a distance not superior to their grove width. Respective outer lugs of the protecting rings 32*a*, 32*b* can be engaged and slide in the grooves G1, G2.

Referring to FIG. 9, it can be seen that the interface device 3 can provide two insertion positions for each of the couplers 20*a*, 20*b*, activation of the container 10 being performed by obtaining the second insertion position for the couplers 20*a*, 20*b* (more inserted position as illustrated for example on the right part of FIG. 9).

Before the activation, the protection mechanism formed by the two protecting rings 32*a*, 32*b* has to be unlocked, as illustrated in FIG. 4 in particular. In other words, each protecting ring 32*a*, 32*b* is acting as retaining element interfering with displacement from a first insertion position to a second position, as long as the interface device 3 has the height H3 with expanded configuration of the protecting rings 32*a*, 32*b*. The protection mechanism prevents accidental movement toward the second position, thus preventing accidental activation opening of a compartment C1 and/or C2. Upon an unlocking action, here using the grooves G1, G2, exerted for having the protecting rings 32*a*, 32*b* in retracted position (with height H3' of the device 3), the couplers 20*a*, 20*b* and the first and second membranes 5*a*, 5*b* respectively associated to these couplers 20*a*, 20*b* can be displaced. As a result, the edges 61, 62 (or similar openers acting as opening means 60*a*, 60*b*) can fold back the first membrane 5*a* along an inner surface of the first coupler 20*a* and fold back the second membrane 5*b* along an inner surface of the second coupler 20*b*, as explicitly shown in FIGS. 8-9. The protection mechanism, with such retaining elements, is efficiently preventing accidental activation and is here advantageously irremovably fastened to the connector 30, so that it is still present if the connector 30 is re-used.

Referring to FIG. 4, the protecting rings 32*a*, 32*b* may displaced by alternating a rotation displacement and a longitudinal translation, due to the design of the grooves G1, G2. The rotation movements may be done along same direction, which is illustrated by the two horizontal arrows when the protecting rings 32*a*, 32*b* have been rotated according to the first rotation movement. A part of the grooves G1, G2 is still visible after such first rotation. Then, the protecting rings 32*a*, 32*b* are longitudinally displaced to be more closely spaced or to be in contact. To prevent a reverse translation, the protecting rings 32*a*, 32*b* are rotated according to the second rotation movement with a guiding effect due to the respective end parts 33, 36 of the grooves G1, G2. More generally, it is understood that the interface device 3 may be formed by assembling one or more pieces, typically pieces of annular shape that are rigid or semi-rigid.

Details of a Second Particular Embodiment of an Interface Device

In a second embodiment as illustrated in FIGS. 5 and 7-9, the interface device 3 only has the connector 30 as a rigid piece. Only tearable tamper evidence elements 9 are fastened to such connector 30, in order to form the interface device 3 that separates the first container body 1 from the second container body 2.

Here, reduction in height of the container 10 may be obtained without manipulating any rigid piece/ring. It can be seen that the connector 30 of the second embodiment may be optionally identical to the connector 30 of the first embodiment, except the outer face of the tubular wall 35 that can be deprived from grooves G1, G2.

The interface device 3 in this embodiment can also provide two insertion positions for each of the couplers 20*a*, 20*b*, activation of the container 10 being performed by obtaining the second insertion position for the couplers 20*a*, 20*b* (more inserted position as illustrated for example on the right part of FIG. 9).

Referring to FIGS. 5, 6A-6B and 7, it can be seen that the interface device 3 can also include a protection mechanism, since at least one retaining element K1 or N1, typically including one or more inner reliefs, may be provided, here in the inner faces F1, F2. Each retaining element interferes with displacement from the first insertion position to the second position, because a complementary relief provided in the couplers 20*a*, 20*b* is engaged and abuts against the retaining element K1 or N1 to stop the insertion when the first insertion position is reached. Such retaining element may be an inner protrusion, a notch or any suitable abutment element.

Figure 13:
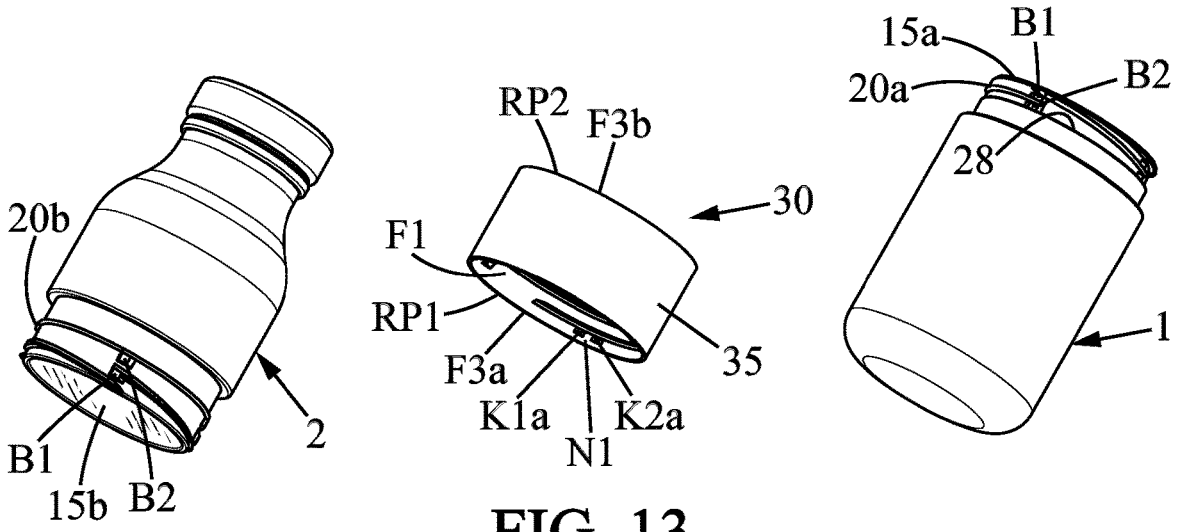
FIG. 13 shows a kit including a single piece re-usable connector and two packaging units.

FIG. 13 also shows a kind of cavity or notch N1 delimited between two reliefs that protrude inwardly in an inner face F1 and/or F2 of the connector 30, thus forming a retaining element. Practically, the first insertion position as illustrated on the left part of FIG. 4 can be maintained, as long as the interface device 3 and the container bodies 1, 2 are not specifically displaced towards each other. Such protection mechanism prevents accidental movement toward the second position, thus preventing accidental activation opening of a compartment C1 and/or C2.

Upon an actuation action exerted by the user for compressing/deforming a plastic relief of the retaining element, the couplers 20*a* and 20*b* can be displaced towards each other. As a result, the first and second membranes 5*a*, 5*b* respectively associated to these couplers 20*a*, 20*b* can be displaced to have the compartments C1, C2 open, as shown in FIGS. 8-9. The protection mechanism, with such retaining elements included in the connector, is still present if the connector 30 is re-used.

Now referring to FIG. 13, it is also shown a single piece connector 30 that is suitable to be re-used. The connector 30 is entirely similar to the connector of FIG. 6B, except for the use of a cavity or notch N1 delimited between two abutment reliefs or stops K1*a*, K2*a*, in the inner face F1 of the first ring part RP1 and possibly identical or same kind of reliefs in the second ring part RP2. Such arrangement in the first inner face F1, with a group of two stops K1*a*, K2*a*, may be provided at a distance less than 5 mm from the corresponding outer open face F3*a* of the first ring part RP1. The two stops K1*a*, K2*a* may be able to be pressed to deform radially outwards, thus allowing accommodating a rigid protrusion that is made of glass (when the first container body 1 is made of glass), this rigid protrusion being an abutment member B1 also proximal to the outer open face F3*a*.

In the coupler 20*a*, another rigid protrusion is optionally forming an abutment member B2 distal/provided at a greater distance from the outer open face F3*a*. The two stops K1*a*, K2*a* act as a retaining element retaining the first container body 1 in the first insertion position, when the abutment member B1 is stopped in the cavity or notch N1 separating the two stops K1*a*, K2*a*. A sloped or beveled profile may be provided in each stop K1*a*, K2*a* and/or in the abutment member B1 to facilitate passing this member B1 over the second stop K2*a*, upon a rotation action exerted manually with a sufficient torque.

The same can apply for reliefs in the second ring part RP2 and for the coupler 20*b*. The other abutment member B2 may be provided to have an end of stroke, corresponding to the second insertion position. In each coupler 20*a* or 20*b*, two, three or four threaded parts may extend between a corresponding number of first abutment members B1 and second abutment members B2.

This may be of interest to having such configuration when the couplers 20*a*, 20*b* are made of glass, as the abutment members a so close from the outer open faces F3*a*, F3*b* that they can be provided in a locally more flexible part of the connector 30. Possibly, a reduction in plastic thickness, a hinge effect or use of two slots (for instance, two longitudinal slots reaching the open face F3*a* or F3B) delimiting the flexible part may be provided, in order to have the stops formed on an elastically deformable part of a ring part RP1 or RP2.

Referring to FIG. 13, the coupler 20*a* of the first container body 1 may include an annular shoulder 28 at an intermediate position between the open top and an annular junction of the neck forming the coupler 20*a* (shoulder junction with the tubular wall of the first container body 1). The outer threads 1*t* or similar guiding reliefs are protruding radially outward above such annular shoulder 28. The inner thread(s) 33*a* provided in the lower ring part RP1 of the connector 30 cannot be engaged beyond the annular shoulder 28. It is understood that the at least two outer reliefs B2 (four lower reliefs B2 may be provided, in four complementary angular sectors) remain unengaged relative to the connector 30 when the container body 1 is in the first insertion position (configuration on the left in FIG. 8). But in such first insertion position, the at least two outer reliefs B1 (four upper reliefs B1 may be provided, in four complementary angular sectors) are engaged in the locking means K1*a*, K2*a*, each relief B1 protruding in the interspace or notch formed between the two stops K1*a*, K2*a*.

When performing a 90° rotation between the connector 30 and the neck/coupler 20*a*, a locking action is exerted first and, at the end of the rotation movement, such interspace of the locking means K1*a*, K2*a* receives a corresponding relief B2 that may be adjacent to the annular shoulder 28. When having four reliefs B1 and four reliefs B2, such outer reliefs B1, B2 may be grouped in pair of axially spaced reliefs B1, B2, located at same angular location on the coupler 20*a* that is of cylindrical shape. Same or similar locking system may be provided in the coupler 20*b*.

Figure 14B:
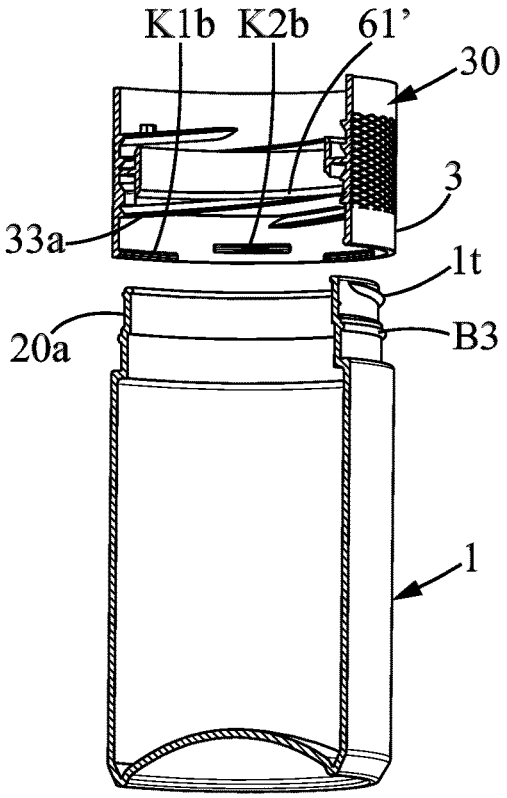
FIG. 14B illustrates a container body in sealed state (without illustrating the content for purpose of clarity) and the connector of FIG. 14A, before fastening the container body to the lower ring part of the connector.

In some variants, the coupler 20*a* is guided along the cylindrical part in similar manner but may include an annular bead B3, as illustrated in FIGS. 14A-14B for instance. Instead of having reliefs B1, B2 distributed at two axially spaced positions on the coupler 20*a*, only a single annular bead B3 may be provided, for instance positioned below the annular shoulder 28. In such option, the locking means K1*b*, K2*b* are provided in two axially spaced positions on the inner face of the connector 30. Typically, in the first insertion configuration, such bead B3 is locked/clipped above at least one first abutment relief K1*b* and below at least one second abutment relief K2*b*, such abutment reliefs being discontinuously formed on the inner face of the lower ring part (the first ring part RP1) of the connector 30. The first abutment reliefs K1*b* and the second abutment reliefs K2*b* may be distributed annularly, preferably using different angular sectors so that a first relief abutment is not in line (along axial direction) with any one of the second abutment reliefs. When the neck or coupler 20*a* is made of glass, resilient deformation of the first and second abutment reliefs K1*b*, K2*b* allow for first insertion (clip action) and for second insertion (typically using a screwing movement), the annular bead B3 made of glass passing over the reliefs K1*b*, K2*b* thanks to elastic deformation. Conversely, if the connector 30 is made of a material more rigid that the material of the first coupler 20*a*, the annular bead B3 (possibly provided with notches) can elastically deform. Same may apply for connection of the second coupler 20*b*.

The connector 30 may be part of a kit including at least one container body 1 or 2, for instance a container body 2 made in glass, also re-usable or easy to be recycled without material loss.

Figure 11:
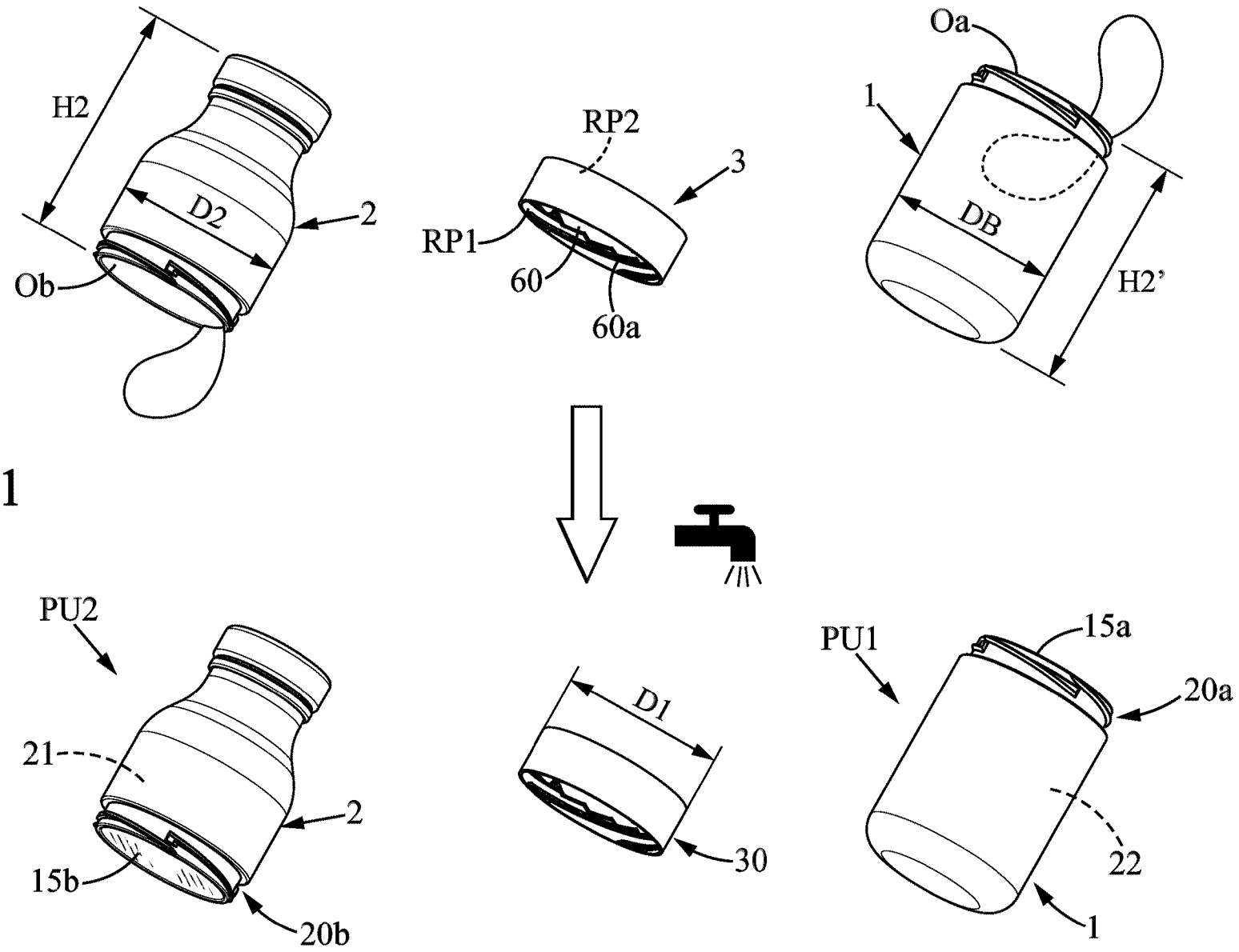
FIG. 11 schematically illustrates way of re-using the connector, typically after a washing step and providing two new packaging units.

In any of the first and second embodiments, the interface device 3 may be adapted to define a container outer wall section 10*c* of a first diameter D1, as illustrated in FIG. 11 for instance. The connector 30, which can define this first outer diameter D1, is preferably longitudinally and directly interposed between the first and second outer side walls (10*a*, 10*b*), which have a same second outer diameter D2 or DB (equal to the first outer diameter D1) or possibly a slightly greater diameter D2 or DB with difference less than 2 or 3 mm (here D2=DB).

Also, in many of the embodiments using a twist actuation, as illustrated in FIG. 8 in particular, the twist movement reduces the final height H1' of the container 10, which is lower than initial height H1.

Referring to FIGS. 8-9, with both compartments C1, C2 communicating with each other via the internal passage 4, the consumer can shake the activated container 10 and mix the different contents 21, 22. Once mixed, the consumer can open the container 10 and drink/eat/use the fresh mix M. The container 10 can keep the same activated configuration when shaking, for example because one or more locking elements K1, N1 (for instance a notch arranged in a thread 33*a* and/or 33*b*) are engaged by a corresponding relief/abutment element B2 prevent any internal displacement in the container structure when performing the shaking.

Packaging Units and their Respective Content

Each container body 1, 2 and its closing means form a packaging unit PU1, PU2 that can be made/sold/obtained separately. The container 10 may be obtained by combining a one-piece thermoplastic connector 30 that is specific and two packaging units PU1, PU2 without limiting choice of packaging material. While the first packaging unit PU1 may be conventional with a single opening delimited by the annular rim 1*r*, and sealed in know manner by the first closure member 15*a*, the second packaging unit PU2 is preferably provided with a lower or inverted neck sealed by the second closure member 15*b* at the opposite from the main opening O1. In some embodiments, the two container bodies 1, 2 may be produced from a same pre-container. Besides, additional elements may also be provided, for example for forming a decorative packaging around a functional part or to seal an additional opening.

The one or more compartments C1 of the first packaging unit PU1 and the one or more compartments C2 of the second packaging unit PU2 are filled and sealed separately. Once the packaging units PU1, PU2 are assembled with airtightness, they can be assembled via any suitable locking/thread design provided in the couplers 20*a*, 20*b* to the ring parts RP1, RP2 of the interface device 3, typically with also a contact or engagement with a pair of protecting members, such as tamper evidence means or movable rings.

In order to provide and maximize a visual effect of the container 10 when using the mixing mechanism, at least the side wall section at the lower side can be made transparent. Also, the two ingredients in the respective compartments C1, C2 can be visually different from one another. For example, a liquid or the like can be contained in one compartment C1, while cereals or other solids can be contained in the other compartment C2. Alternatively, a transparent liquid or gel in one compartment can be mixed with a colorful composition (with fruits, soda, or the like if the mixing corresponds to a food composition) initially contained in the other compartment.

In a specific exemplary embodiment, the two ingredients or contents 21, 22 are two liquid components of a mixed drink that are intended to be mixed with one another to form the final mixed drink. For example, the first compartment C1 can hold a fruit juice, such as orange juice or another juice, like cranberry juice, and the second compartment C2 can hold alcohol, such as vodka. The first and second ingredients/contents (liquids) should optionally be complementary to one another in that in the resulting mixed drink, the first and second liquids are mixed with one another.

Figure 12B:
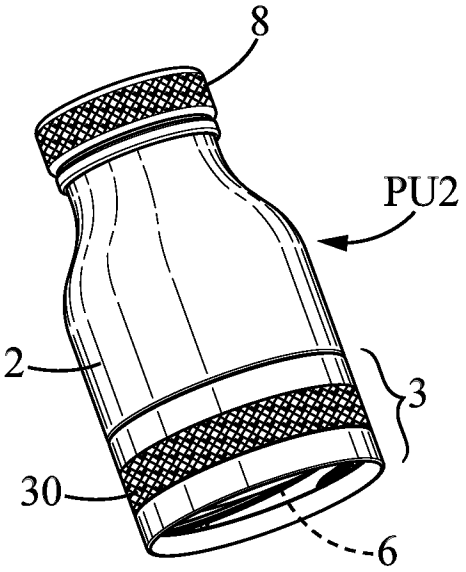
FIGS. 12A and 12B show example packaging units, here including a metal material, adapted to cooperate with the interface device that also may comprise metal at least in the connector of the interface device.
Figure 12A:
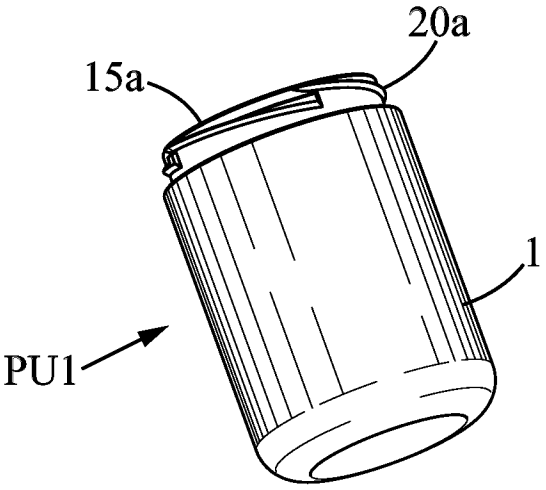

Optionally, the first container body 1 is a refill, so that the first compartment C1 contains the content (a concentrated solution or similar product for instance) of such refill, while the container body 2 forming the second compartment C2 may be re-used and can be filled with water, milk or similar dilution liquid. Alternatively, the refill and/or the concentrated solution may be in the upper compartment (second compartment C2), here adjacent to the end opening O1. Referring to FIGS. 12A-12B, the refill, here the packaging unit PU1, may be of reduced height as compared to the reusable container body, for instance with a height at least twice lower than height of the complementary packaging unit PU2.

The content 21, 22 may be at least partly constituted of food product, flowable detergent, cosmetic, health/medical, biopharmaceutical product. Preferably, the interior volume of the container 10 taken as a whole is inferior or equal to 1 or 2 L, for example with reduced height less than 45 or 50 cm and/or with maximal diameter or transversal size inferior to 25 or 30 cm but superior to 7 cm. The container 10 may thus be compact, and preferably easy to grasp by a single hand.

The container 10 has two compartments C1 and C2 that may be of any suitable capacity. Each container body 1, 2 may have a capacity of, or containing a content of a volume of (or mass of) of 15 or 20 ml (15 g or 20 g), to 1 L (or 1 kg), for example a container of 15 ml (or 15 g) to 50 ml (or 50 g), or 50 ml (or 50 g) to 100 ml (or 100 g), or 100 ml (or 100 g) to 125 ml (or 125 g), or 125 ml (or 125 g) to 150 ml (or 150 g), or 150 ml (or 150 g) to 200 ml (or 200 g), or 200 ml (or 200 g) to 250 ml (or 250 g) or 250 ml (or 250 g) to 300 ml (or 300 g), or 300 ml (or 300 g) to 500 ml (or 500 g), or 500 ml (or 500 g) to 750 ml (or 750 g), or 750 ml (or 750 g) to 1 L (or 1 kg).

A compartment C1, C2 can be filled with any content, the container 10 being a packaging element useful to transport, protect, preserve, and/or otherwise procure said content.

The content 21, 22 can be any kind of content to be procured to a user, for example a consumer, in moderate quantities. The content can for example parts of a food or beverage composition, a drug composition, a personal-care composition, a home-care composition, a home improvement composition, a toy, a small part good.

In one embodiment the first content is a fluid, for example a liquid, and the second content is a solid, for example in the form of powder, granules, flakes, or clusters. In one embodiment the second content is a fluid, for example a liquid, and the first content is a solid, for example in the form of powder, granules, flakes, or clusters. In one embodiment the first and the second contents are fluids, for example liquids. In one embodiment the first and the second contents are solids, for example in the form of powder, granules, flakes, or clusters.

Examples of personal care compositions include hair care compositions such as shampoo compositions, conditioner compositions or hair coloring compositions, skin compositions such soap compositions, body wash compositions, sun protection compositions, hydrating compositions or anti-aging compositions, and make-up compositions. The two contents can be for example two complementary parts of a hair coloring composition, to be mixed just before application onto hair.

Examples of home-care compositions include, fabric care compositions such as laundry compositions or softener compositions, dish-washing compositions such as manual dish washing compositions or automatic dish washing compositions, hard-surface cleaning compositions, such as kitchen cleaning compositions, bathroom cleaning compositions, wood floor cleaning compositions or tiles cleaning compositions.

Examples of home improvement compositions include paints, glues, plasters or cements compositions.

Examples of drug compositions include compositions comprising an active powder or liquid to be mixed with a drinkable medium such as water. For example, the first content can be water or a beverage and the second content can be aspirin in a powder form or an inorganic composition for intestinal or gastric disorders.

Food or beverages are compositions that are to be orally consumed. This can be in various forms including liquid, viscous semi-fluid, or solid, optionally as a powder. The food can be a spoonable viscous semi fluid composition or spoonable solid. It can be for example or scoopable solid, as opposed to a spoonable powder.

The beverage can be water, carbonated or non-carbonated, non-alcoholic beverages (also referred to as soft drinks), carbonated or non-carbonated, alcoholic beverages, carbonated or non-carbonated, milk or vegetal milk substitutes.

The food can be cereals, dairy compositions, vegetal dairy substitute compositions, deserts compositions such as creams, mousses, gels, puddings, ice-creams compositions, fruits, vegetables, or fruit or vegetables compositions for example whole fruits or whole fruit parts, fruit purees or jams, meat or meat substitutes, confectionary compositions, sauces compositions, soup compositions, infant nutrition compositions, medical nutrition compositions, coffee creaming or whitening compositions, coffee or chocolate compositions, for example instant coffee or chocolate, or other grocery compositions.

In one embodiment the first content is a liquid dairy or vegetal dairy substitute composition and the second content is cereals. In one embodiment the second content is a liquid dairy or vegetal dairy substitute composition and the first content is cereals.

In one embodiment the first content is water and the second content is an infant formula in powder form. In one embodiment the second content is water and the first content is an infant formula in powder form.

All or part of the food can be a frozen composition (with provision that mixing action is permitted at ambient temperature), chilled or fresh, typically with a storage at a temperature of from 0° C. to 10° C., or long shelf ambient temperature food, typically with a storage at a temperature of higher than 15° C.

In some embodiments the food is a wet food compositions, comprising substantial amounts of moisture or water, as opposed to dehydrated food compositions, for example at least 20% by weight, or at least 30% by weight, or at least 40% by weight, or at least 50% by weight, or at least 60% by weight, at least 80% by weight. Such compositions can be more sensitive to contaminations and a high resistance sealing, for example with a high vacuum leak resistance, can be appropriate.

Dairy compositions or vegetal dairy substitute compositions typically comprise of dairy material or a dairy substitute material. Herein, unless otherwise provided "dairy" or "milk" can encompass vegetal substitutes, for example based on soy, oats, almond, rice, coconut and mixture thereof.

The dairy composition can be for example a dessert, a fermented dairy composition such as yogurt or kefir, a cheese, butter.

The dairy material is typically comprised of milk and/or ingredients obtained from milk. It is also referred to as a "milk-based composition". Herein milk encompasses animal milk, such as cow's milk, and also substitutes to animal milk, such as vegetal milk, such as soy milk, rice milk, coconut milk, almond milk, oats milk etc. . . .

Dairy compositions are known by the one skilled in the art of dairy products, preferably of fermented dairy products (typically that can be consumed in a flowable state, allowing mixing). Herein a milk-based composition encompasses a composition with milk or milk fractions, and compositions obtained by mixing several previously separated milk fractions. Some water or some additives can be added to said milk, milk fractions and mixtures. Preferably the milk is animal milk, for example cow's milk. Some alternative animal milks can be used, such as sheep milk or goat milk.

The milk-based composition can typically comprise ingredients selected from the group consisting of milk, half skimmed milk, skimmed milk, milk powder, skimmed milk powder, milk concentrate, skim milk concentrate, milk proteins, cream, buttermilk and mixtures thereof. Some water or additives can be mixed therewith. Examples of additives that can be added include sugar, sweeteners, fibers, and texture modifiers.

Exemplary Container Bodies

Now referring to FIGS. 1-2, 8, 11 and 12A-12B, it can be seen that the container 10 may form a bottle assembly that combine two bottle elements. The first container body 1 and the second container body 2 can be produced from a single pre-container or from various container parts (independently produced). Here only the second container body 2 is axially opened at two opposite ends, in order to define the opening O1 that may be sealed by a cap 8.

Each container body 1, 2 may be produced by a molding technology, for instance extrusion blow molding (EBM), injection stretch blow molding (ISBM) or injection molding.

Blow molded container bodies 1 and 2 may be provided for reducing the amount of plastic material.

Use of same material for the container bodies 1, 2 is of interest for recycling. At least one section of the side wall of the container 10 can be transparent or translucent. Preferably, the first container body 1 and the second container body 2 are each transparent.

Optionally, the container side wall may be provided with ribs, for instance generally spiraling or helical external ribs, on one or two of the two container sections formed by the first container body 1 and the second container body 2. Such ribs facilitate gripping for twisting. In a preferred embodiment, the ribs extend spiral around the first container body 1 and around the second container body 2 in opposite directions. When obtaining the bodies 1, 2 from a pre-container, such pre-container already includes such ribs.

FIGS. 12A and 12B illustrate respectively a first container body 1 including or made of metal or glass, and a second container body 2 comprising metal or glass. In such an option, fluid tight connection between the first compartment C1 and the second compartment C2, when the internal passage 4 is released, can be obtained by inserting an elastomer seal of annular shape between the coupler 20*a* or 20*b* and of the interface device 3. In some options, a fluid tight seal with the connector 30 may be obtained by induction sealing one of the compartments, before a final assembling step.

Besides, the connector 30 may optionally be made of metal and possibly the cap 8 as well. More generally, the two packaging units PU1, PU2 may be formed from a wide variety of materials for the container bodies 1, 2.

The second container body 2 may have larger cylindrical outer face than the first container body 1, and is thus suitable to have (optionally) a paper label or any kind of label surrounding such outer face. Such covered face may be made of thermoplastic material or glass, in non-limiting examples.

Tamper Evidence and Way the Connector Works

Referring to FIGS. 1, 3-5 and 8, the interface device 3 may be provided with at least one band-like element or strap that may be torn to be detached from a longitudinal attachment edge 9*b* fastened to an outer face of the connector 30 and also for instance in region of respective outer shoulders 24*a*, 24*b* (see edge 9*a* in FIG. 5) of the container bodies 1, 2. The interface device 3 may be provided with such band-like elements that are each suitable to form a tamper-evidence element 9, after a complementary bonding of this element to the container body 1 or 2. The bonding is performed after assembling the couplers 20*a*, 20*b*, possibly in an air-tight manner, with the connector 30.

Before use of the container 10, the tamper-evidence element 9 can be peeled. The strap is suitable in helping the consumer to know that the mechanism hasn't been activated. Once the strap has been removed, the consumer twists both components of the container 10 in opposite directions. This twist is about 80 or 90 degrees in the illustrated drawings (see FIG. 8 for instance), but can be adjusted from 10-270 degrees, depending on the needs.

Referring to FIGS. 5 and 9, the interface device 3 is ring-shaped and may be provided with two separate tamper-evidence elements 9, typically elongated to circumferentially cover an outer annular recess R respectively delimited between the connector 30 and a shoulder 14 of the body 1, and between the connector and a shoulder 24*b* of the body 2. Each tamper evidence element 9 may be a band and has two opposite parallel edges 9*a*, 9*b*, only one of which is connected to the connector 30. With the edge 9*b* connected to the connector 30 and the other edge 9*a* connected to shoulder 24*a* or 24*b*, and with a circular or similar shape to entirely encircle the recess R, the tamper-evidence elements 9 may prevent inadvertently twisting the container 10.

Referring to FIG. 8, the tamper evidence elements 9 can entirely surround the respective couplers 12, 22, so that the recess R is not visible before tearing at least one removable part of the tamper evidence element 9. Then, the container bodies 1, 2 become relatively easy to be turned/rotated after removal of these elements 9. More generally, the interface device 3 may be provided with one or more mobile rings or any removable device attached to the connector 30 to prevent the teeth, the pushing edge or similar opening means 60*a*, 60*b* from engaging and displacing (typically via piercing) all or part of the sealing membrane 5*a*, 5*b* of the closure members 15*a*, 15*b*.

Use of protecting rings 32*a*, 32*b* as in the first embodiment is of interest because no part can be lost, which is better for preventing accidental loss of plastic parts. Such protecting rings 32*a*, 32*b* may thus be re-used with the connector 30.

Besides, it is understood that any tamper evidence means may be provided, for example using frangible bridge portions that are necessarily broken before moving any coupler 20*a*, 20*b* of the container bodies 1, 2 relative to the connector 30, so that any actuation of the mechanism can be perceived when observing the interface device 3. A rigid ring 32*a*, 32*b* or another kind of annular band may be provided with such frangible bridge portions connected to each the connector 30. Of course, the tamper evidence means may comprise or consist in discontinuous elements, including frangible bridge portions connected to any part of the connector 30.

As illustrated in FIG. 3, each coupler 20*a*, 20*b* is of cylindrical shape, to mate with the annular bearing portions delimiting each a receiving housing 31*a*, 31*b*. While such cylindrical design is required when the interface device 3 provides a twist movement for obtaining the activated configuration, it is understood that other shapes may be chosen when the puncturing or pushing of the closure members 15*a*, 15*b* is only linearly actuated, parallel to the longitudinal axis A (without any rotation or without significant rotation around the longitudinal axis A). When having such linear actuation, the first edge 61 used to puncture the membrane 5*a* may represent more than 75% of the total circumference of the free end of the cylindrical part 60. The same can apply for the second edge 62.

Once the tamper-evidence elements 9 or the protecting discs or rings 32*a*, 32*b* are displaced away from the couplers 20*a*, 20*b*, the user can easily actuate a breakage, preferably a simultaneous breakage of the two membranes 5*a* and 5*b*. For instance, after twisting 30 degrees, as shown in FIG. 8 with the opposite grey arrows, the pressure exerted by each series of teeth or similar opening means 60*a*, 60*b* is enough to start to break the corresponding membrane 5*a*, 5*b*. After 60 degrees, the cutting mechanism formed by such teeth or similar edges 61, 62 has broken the desired zone (circular or partly circular zone). After about 90°, full activation is reached and the connector 30 is thus blocked, due to at least one detent/locking member. The consumer can mix the product (here content 21+content 22) from the different compartments, here superimposed compartments C1 and C2. On the right on FIG. 9, it can be seen that the membranes 5*a*, 5*b* have been sufficiently pierced and/or pushed toward the corresponding compartment (respectively C1, C2).

While illustrated embodiments show a membrane 5*a* or 5*b* that is flexible for sealing the compartment C1 or C2, it is understood that other closing elements can be used, for instance a lid of rigid material, preferably arranged as a thin layer or a hinged closing element. Any king of lid adapted to be moved in reaction to a pushing by a coupler can be used, provided that the opening of the compartments C1, C2 can be performed simultaneously. Of course, the user may choose to open the compartments C1, C2 not simultaneously, for example if the user immobilizes the connector 30 while rotating and/or pushing only one of the container bodies 1, 2.

As illustrated in FIGS. 9-10, the puncturing structure 6 or similar structure forming the opening means 60*a* and 60*b* may be designed and oriented with respect to the closure members 15*a*, 15*b* so that movement in a first direction, of the first container body 1, relative to the connector 30, causes a movement in this first direction of the piercing members or similar opening means 60*a* such that the closure members 15*a*, 15*b* are displaced in an open state. When using piercing members that can partially pierce the membrane 5*a*, a connection is typically maintained between the closure member 15*a* (that includes the pierced membrane 5*a*) and a portion of the circumferential attachment surface. With such an arrangement, when the first direction is an upward direction, the closure member 15*a* is not entirely falling in the lower compartment C1.

Such final position is shown in FIGS. 8-9. This final position of the closure member 15*a* is reached after movement of the puncturing structure 6 of the connector 30, relative to the first container body 1. Here, the puncturing structure 6 also has another series of teeth, piercing members or similar opening means 60*b*, which are designed and oriented with respect to the other facing membrane 5*b* so that movement in a second direction (opposite to the first direction), of the second container body 2, relative to the connector 30, causes a movement in this second direction toward the piercing members such that the piercing members can partially pierce the membrane 5*b*. A connection is here maintained between the closure members 15*a*, 15*b* (that includes the pierced membrane 5*a*, 5*b* respectively) and a portion of a corresponding circumferential attachment surface in a container body 1 or 2 (respectively).

Referring to FIG. 14A, the interface device 3 may comprise a cutting blade or similar opener 60*a*, 60*b* having a helical edge 61'. At least one edge 61' may be slanted. The lower edge at the lower end of the cylindrical part 60 may be provided with a lowermost end E61 (preferably only one lowermost end E61). Here, the bevel edge of the cutting blade is adapted for contact with the membrane, with a progressive increase of the contact area. The initial contact is obtained at a lowermost end E61 of the edge 61'. A side bevel, here adjacent to the helical edge lowermost edge E61, is provided at a leading end of the cutting blade. With such arrangement, the membrane 5*a* of the closure member 15*a* or 15*b* is cut progressively in adapted manner, without undesirable fold and without full detachment of the membrane 5*a* when the rotation between the connector 30 and the container body 1 or 2 does not exceed 180°. In the predetermined position (first insertion position) of the lower container body 1, the lowermost end E61 may be adjacent the top face of the membrane 5*a* without starting the puncturing. The same optionally applies at the upper end of the cylindrical part 60, for forming an uppermost end with a cutting angle.

Regarding the lower cutting edge 61' illustrated in FIG. 14A, the bevel is here such that the edge 61' (cutting edge) extends at the lower end of the cylindrical part outer surface. The same applies for the side bevel, with a substantially vertical edge shifted externally as compared to the inner face of the cylindrical part. With such arrangement as illustrated in FIG. 14A, a cutting angle is provided at the lowermost end E61, possibly with an angle of about 90° or slightly less, at intersection between the lower cutting edge 61' and the upwardly extending cutting edge. Similar arrangement may be provided at the opposite, with a cutting angle provided at the uppermost end.

Optionally, the movement of the second container body 2 may be actuated by grasping the container 10 at the second outer side wall 10*b* formed by the second container body 2, possibly by rotating/twisting in opposite directions the first container body 1 and the second container body 2. In other words, the bodies 1, 2 need simply to be twisted in opposite directions to allow the disc-like connector 30 to be activated and obtain the second configuration of the container 10 as illustrated on the right in FIGS. 8-9.

The longitudinal component of each container body displacement can be low, especially when height H3 of the interface device 3 (measured parallel to the longitudinal axis A, which is here a central axis of the interface device 3) is also low, typically lower than 50 or 60 mm. This is of interest to form a compact container 10.

Still referring to FIGS. 8-9, it can be seen that in the activated position, the first content 21 and the second content 22 mix as the content 22 in the upper compartment, here the second compartment C2, falls by gravity and enters the lower compartment, here the first compartment C1. After mixing occurs, the consumer removes the lid or cap 8. The consumer thus enjoys the freshly mixed composition (drink, heterogeneous composition or the like) when the composition is a food composition. The opening O1 may be formed in a way different from what is shown in FIG. 1, depending on the needs.

Unlike conventional systems used to mix a beverage, the interface device 3 of container 10 can provide efficient air tightness around the mixing interior volume before and after actuation of the mixing. Indeed, the interface device 3 is provided with:

- inner face F1, F2 complementary to the coupler structures, providing an air-tight sealing contact at each fastening junction between the cylindrical coupler of the container body and the ring part RP1 or RP2 of the connector 30; and
- two opening means 60*a*, 60*b* which are configured to push/pierce the membrane, at a distance from an/or with radial offset relative to the contact area coupler—ring part, thus without interfering with the air-tight sealing.

Assembling

Now referring to FIGS. 1-3 and 11, exemplary assembling methods to produce a container 10 in accordance with the invention will be described. Here, both upper and lower bottles/container bodies 1, 2 have matching heights H2, H2' and same outer diameter D2=DB for simplified handling & distribution. Also the couplers 20*a*, 20*b* can have same outer diameter D4 that is slightly lower than internal diameter of the connector tubular wall 35.

In some options, as illustrated in FIGS. 12A-12B, aluminum or steel may be used in to form the two container bodies 1, 2. For transport efficiency, each the bottle/container body 1, 2 is based on standard aluminum can diameters which are well optimized (typically 58.1 mm diameter based on 250 ml can).

Before the assembling steps, it is understood that the respective closure members 15*a*, 15*b* are typically already sealing the corresponding container body 1 or 2, so that the first container body 1 is closed and the second body 2 is closed before the fastening of the connector 30. The packaging units PU1, PU2 are thus firstly obtained before the assembling, with typically a breachable membrane 5*a*, 5*b* arranged perpendicular to the height direction of the packaging units PU1, PU2. This is of interest as the interface device 3 may contain a re-usable connector 30 or may be a re-usable interface device 3.

The filling steps for filling the compartment C1, C2 are performed separately. The filling step related to the first compartment C1 uses here a single access corresponding to the opening at the rim 1*r* to be sealed by the first closure member 15*a*, while the filling step related to the second compartment C2, that directly opens outside via the opening O1 when a lid or cap 8 is not present, can be performed either via the opening O1 or via the opening Ob at the rim 2*r*. Optionally, such filling step related to the second compartment C2 does not use any access opening sealed by the second closure member 15*b*. As a result, the closure member 15*a* may be sealed after the filling step related to the first compartment C1, while the closure member 15*b* may be sealed before the filling step related to the second compartment C2.

The connector 30 is not used at such stages. The technology FFS (Form, Fill and Seal) may typically be used to produce at high rate the packaging units PU1, PU2. The container body 2 is conventionally sealed by a cap 8, which represents an additional step for sealing the compartment C2 as the closure member 15*b* is also made separate from the container body 2. In some variants, the container body 2 may be provided with a bottom having an integral frangible part (possibly hinged), suitable to form a bottom of the packaging unit, in order to suppress the additional sealing step. In such option, the opening means 60*b* are configured to push and pierce in the area of the frangible part.

Production of the cap 8 and the closure members 15*a*, 15*b* need not be described in detail.

Referring to FIGS. 3 and 11, the interface device 3 can be assembled and interposed later between the sealed ends of the packaging units PU1, PU2, optionally with two outer junctions obtained by tamper-evidence elements 9 or protecting rings 32*a*, 32*b* that are supported by the connector 30.

The interface device 3 may be an assembly of several injection molded pieces of thermoplastic material or composite material: the connector 30 and the protecting rings 32*a*, 32*b* for example. Such arrangement can be obtained without any possibility to separate the protecting rings 32*a*, 32*b*, so that a user may re-use the interface device 3 without performing any additional assembly step, only the couplers 20*a*, 20*b* having to be inserted in the connector 30 at its opposite open faces.

The container 10 is obtained after two fastening steps, in which a same connector 30 of the interface device 3 is involved. Here, the connector 30 may be coupled and fastened to the container bodies 1, 2, the container body 1 being indifferently fastened before or after the container body 2. After such fastening of the container bodies 1, 2, the first configuration of the container 10 is obtained, in which the first opening means 60*a* are facing the first closure member 15*a* sealing the first compartment C1 and the second opening means 60*b* are facing the second closure member 15*b* sealing the second compartment C2. The couplers 20*a*, 20*b* are partly inserted as compared to a final insertion position to be obtained in the second/activated configuration. More generally, any suitable coupler can be used to have a first position for fastening a container body to the connector 30, while being still able to move further/farther and permit the closing element, here a membrane 5*a*, 5*b* supported by the container body, to be breached or reach a releasing state opening the internal passage 4.

According to some options, after achieving the assembling steps, the containers 10 (in inactivated state of course, and typically provided with tamper evidence means) may be grouped in a pack. For example, a wrapping element made of cardboard or plastic may be used for packing the containers 10 in two rows. The wrapping element, may define a top panel, a bottom panel and at least two side panels. Spacing elements, for example a beam member or folded members, may be optionally provided to maintain the containers in parallel rows.

Such food pack may be provided with at least one row of containers 10.

In some other options of interest, the user already possesses the connector 30 and only food packs provided with the first packaging units PU1 and food packs provided with the second packaging units PU2 are required to be combined with the connector 30. A fool-proofing means may optionally be used to prevent combining, via the connector 30, packaging units having the same kind of content 21 (or same kind of content 22).

Referring to FIGS. 12A-12B, the original connector 30 may be re-used with an associated original bottle/container body 2 that is deprived from any closure member. In other words, at least the connector 30 or the whole interface 3, the container body 2 and the associated cap 8 (i.e. everything illustrated in FIG. 12B) can be re-used. Only the container body 1 and its closure member 15*a*, in the packaging unit PU1 illustrated in FIG. 12A, forms a disposable part after consuming the mix M. Of course, the content 22 to be filled in the compartment C2 of the container body 2 may be obtained by any suitable way, typically bulk material or paper packed product for lowering plastic material waste. The content 22 is filled through the annular open end Ob. Such kind of use is of great interest as there is no or very reduced plastic waste: only the container body 1, which could be also made of recyclable plastic material such as PET or similar plastic material, possibly aluminum/metal or glass, can be considered as a lower disposable container body.

Of course, when the connector 30 is re-used, it may also be fastened to the first container body 1 first, as illustrated by the state (A2) in FIG. 3, before reaching the state (A1) via a last assembling step to engage the second coupler 20*b* to the inner face F2 of the connector ring part RP2. If the container body 2 is provided without any closure member 15*b* sealing the opening Ob, such last step may be performed with the container body 2 filled and maintained in an inverted position, until the coupling with the connector in a fluidtight manner.

All or part of the first and second container bodies 1, 2 mays also be re-used in some options, for instance if made of glass or metal material. The bodies may be sent back for refilling (to a dedicated company that supplies refills).

The present invention has been described in connection with the preferred embodiments. These embodiments, however, are merely for example and the invention is not restricted thereto. For instance, while the drawings show a coupling mechanism having inner threads 33*a*, 33*b* facing inwardly and formed in the inner faces F1, F2 of the tubular wall 35, alternative coupling means may be used. Such coupling means can also be provided in an outer skirt of the interface device, either internally or externally.

Additionally, each body container 1, 2 is not necessarily pivoting around a central/longitudinal axis A of the connector 30. In a variant, a cam element may be provided to guide a sliding movement (not necessarily strictly parallel to the central axis A) or a linear movement is obtained without rotation of the coupler 20*a* or 20*b*.

In some embodiments, the connector 30 can include a pair of circumferentially spaced actuating elements to unlock an axial sliding of at least one coupler 20*a*, 20*b* relative to the connector 30. With a single hand, a consumer may simultaneously push the actuating elements to unlock the sliding (radial push in inward direction, to suppress a retaining effect) and axially push the second container body 2 closer to the first container body 1, so at to slidably move the puncturing structure 6 or similar structure with the opening means 60*a*, 60*b* of the connector 30 between an initial position and an activated position. Typically, a final locking action may be provided to prevent reverse movement of the puncturing structure 6. Actuation can be done by a simple linear gesture.

It will be understood by those skilled in the art that other variations and modifications can easily be made within the scope of the invention as defined by the appended claims, thus it is only intended that the present invention be limited by the following claims.

Any reference sign in the following claims should not be construed as limiting the claim. It will be obvious that the use of the verb "to comprise" and its conjugations does not exclude the presence of any other elements besides those defined in any claim. The word "a" or "an" preceding an element does not exclude the presence of a plurality of such elements.

For instance, the annular ends 1*a*, 1*b* used for the container bodies 1, 2 are not necessarily sealed by a flexible membrane 5*a*, 5*b* and/or not necessarily provided with circular edges. Other shapes, including straight edge portions may be used. Besides, the side wall of each container body does not necessarily always extend regularly around a longitudinal axis A, here illustrated as a symmetry axis. Of course, the container body side wall may also be provided with a longitudinal irregular profile and/or significant curves, possibly with at least one oblique gripping part or oblique shoulder.

The invention claimed is:

1. An interface connection device that delimits an internal passage, the interface connection device comprising:

a connector of annular shape configured to connect a first container body and a second container body, the connector comprising a first end female part configured to receive a corresponding male part that is formed as a first coupler of the first container body and is bearing a first membrane sealing a first compartment delimited in the first container body, the first end female part forming a first outer open face of the connector, a second end female part configured to receive a corresponding male part that is formed as a second coupler of the second container body and is bearing a second membrane sealing a second compartment delimited in the second container body, the second end female part forming a second outer open face of the connector, a first opener comprising a first contact end or edge that is facing outwardly in a first direction and provided to selectively displace all or part of the first membrane toward the first direction, and a second opener comprising a second contact end or edge that is facing outwardly in a second direction away from the first direction, and provided for selectively displacing all or part of the second membrane toward the second direction;

wherein the connector is a double opener connector, wherein at least one of the first and second end female parts provides a first insertion position and a second insertion position for the corresponding male part, the interface connection device comprising at least one retaining element interfering with displacement from the first insertion position to the second insertion position so that the first insertion position is typically a predetermined position, wherein the interface connection device is configured to permit passing from the first insertion position to the second insertion position upon one or more of an actuation action and an unlocking action exerted to allow the first and second membranes to be respectively displaced by the first and second openers, so that the first and second compartments are open toward the connector and the internal passage thus selectively allowing communication between the first compartment and the second compartment, wherein the first end female part is formed as a first ring part and the second end female part formed as a second ring part, an annular sealing contact, preventing any leak of liquid outside from the internal passage, being created between respective inner faces of the first ring part and the second ring part and the corresponding male part, when passing from the first insertion position to the second insertion position, wherein an annular sealing contact, preventing any leak of liquid outside from the internal passage, is already created between respective inner faces of the first ring part and the second ring part and the corresponding male part, in the first insertion position before passing from the first insertion position to the second insertion position, wherein the interface connection device has two opposite axial ends provided in two distinct pieces, the two opposite axial ends being spaced to define a maximal height of the interface connection device, in a first configuration, while in a second configuration the two opposite axial ends are spaced to define a lower height of the interface connection device as compared to the maximal height, and wherein the two opposite axial ends are each irremovably secured to a respective fastening and guiding part provided in the connector, in order to surround an external tubular wall of the connector both in the first configuration and in the second configuration.

2. The interface connection device according to claim 1, wherein each of the first and second end female parts provides a first insertion position and a second insertion position for the corresponding male part, the interface connection device further comprising:

at least one first irremovable retaining element, included in or secured to the first end female part of the connector in order to be irremovable relative to the connector, interfering with displacement from the first insertion position to the second insertion position so that the first insertion position is a predetermined position inside the first end female part, and at least one second irremovable retaining element, included in or secured to the second end female part of the connector in order to be irremovable relative to the connector, interfering with displacement from the first insertion position to the second insertion position so that the first insertion position is a predetermined position inside the second end female part, wherein the double opener connector is made of a single piece.

3. The interface connection device according to claim 1, wherein the connector is a single piece of plastic material or metal provided with:

an intermediate part including an annular peripheral junction joining the first end female part and the second end female part, and a tubular wall delimiting all or part of an exterior face of the interface connection device, the annular peripheral junction being included in the tubular wall, wherein the intermediate part comprises a radial part or transverse wall transversally connecting the tubular wall to a cylindrical part that includes the first contact end or edge and the second contact end or edge, the tubular wall and the cylindrical part delimiting two housings separated by the transverse wall.

4. The interface connection device according to claim 1, wherein the first end female part and the second end female part are integral and inseparable parts of the connector, at least one of which comprises an inner face provided with:

an inner guiding track that includes a first coupling section and a second coupling section, and at least one stopper forming the retaining element configured to provisionally block the corresponding coupler in an intermediate position along the inner guiding track, which is a predetermined position.

5. The interface connection device according to claim 1, wherein the connector is a single piece of plastic material or metal provided with a tubular wall delimiting all or part of an exterior face of the interface connection device, and wherein the first opener and second opener are arranged in an interior volume delimited by the tubular wall and belong to a same cylindrical part.

6. A kit for assembling a container having separate compartments, the container allowing keeping contents in the separate compartments that are distributed in a first container body and a second container body, the kit comprising:

the first container body;

the second container body, the first container body and the second container body each having a membrane sealing a container body compartment and a coupler arranged at a container body annular end which is sealed by a given membrane; and an interface connection device configured to connect the first container body to the second container body, the interface connection device delimits an internal passage, the interface connection device comprising a connector of annular shape configured to connect a first container body and a second container body, the connector comprising a first end female part configured to receive a corresponding male part that is formed as a first coupler of the first container body and is bearing a first membrane sealing a first compartment delimited in the first container body, the first end female part forming a first outer open face of the connector, a second end female part configured to receive a corresponding male part that is formed as a second coupler of the second container body and is bearing a second membrane sealing a second compartment delimited in the second container body, the second end female part forming a second outer open face of the connector, a first opener comprising a first contact end or edge that is facing outwardly in a first direction and provided to selectively displace all or part of the first membrane toward the first direction, and a second opener comprising a second contact end or edge that is facing outwardly in a second direction away from the first direction, and provided for selectively displacing all or part of the second membrane toward the second direction;

a tubular wall delimiting an exterior face of the interface connection device;

two guiding tracks distributed at the first end and second end female parts, in the tubular wall, the two guiding tracks comprising a first track extending at a first inner face included in the tubular wall and a second track extending at a second inner face included in the tubular wall;

a first housing and a second housing, each delimited outwardly by the first inner face and the second inner face, respectively, and delimited inwardly by an outer periphery of a cylindrical part of the connector, the cylindrical part having an inner face that delimits the internal passage, the internal passage being configured to be sealed between two membranes in an assembled state of the container before mixing the contents, wherein the connector is a double opener connector, wherein at least one of the first and second end female parts provides a first insertion position and a second insertion position for the corresponding male part, the interface connection device comprising at least one retaining element interfering with displacement from the first insertion position to the second insertion position so that the first insertion position is typically a predetermined position, wherein the interface connection device is configured to permit passing from the first insertion position to the second insertion position upon one or more of an actuation action and an unlocking action exerted to allow the first and second membranes to be respectively displaced by the first and second openers, so that the first and second compartments are open toward the connector and the internal passage thus selectively allowing communication between the first compartment and the second compartment, and wherein the coupler of the at least one container body is removably fastened to one of the two guiding tracks, each of the two guiding tracks comprising a transition relief forming all or part of the retaining element and separating a front track section from a rear track section, so that the coupler is adapted to be actuated, by passing over the transition relief:

(i) from a first position, in which the coupler is engaged in the front track section so that the coupler is axially facing a determined housing amongst the first housing and the second housing, the given membrane being unengaged by any of the first opener and the second opener in the first position, (ii) to a second position, in which the coupler is engaged in the rear track section so that the coupler and a margin portion of the given membrane penetrate the determined housing and one of the first opener and the second opener has engaged the given membrane to allow the internal passage to be filled with content, thus allowing mixing of the contents initially stored in the separate compartments when the first container body and the second container body are connected by the interface connection device and have their coupler in the second position.

7. The kit according to claim 6, wherein the coupler is passing from the first insertion position to the second insertion position by moving the coupler relative to the connector, while the at least one retaining element is simultaneously kept in a predetermined position so that the at least one retaining element remains stationary relative to the connector.

8. A method for assembling a container for keeping contents in separate compartments before use, the method comprising:

providing a first container body with a first compartment configured to contain a first content, a first closure member sealing the first compartment;

providing a second container body separate from the first container body, the second container body having a second compartment configured to contain a second content, a second closure member sealing the second compartment;

providing an interface device, separate from the first container body and separate from the second container body, the interface device being configured to connect the first container body to the second container body, an internal passage being delimited by the interface device, allowing communication between the first compartment and the second compartment;

providing the first opener and the second opener in a connector forming all or part of the interface device, the connector comprising a tubular wall delimiting an exterior face of the interface device, the first opener and the second opener being disposed inside the tubular wall, the interface having two opposite axial ends that are opposite end female parts of the connector, the axial ends each providing a first insertion position and a second insertion position for a corresponding male part in the form of a coupler;

coupling and fastening the first container body, which is already filled with the first content in the first compartment delimited by the first container body, to one of the two opposite axial ends of the interface device;

coupling and fastening the second container body, which is already filled with the second content in the second compartment delimited by the second container body, to the other one of the two opposite axial ends of the interface device; and maintaining a first configuration of the container, in which the first opener is facing a first closure member sealing the first compartment and the second opener is facing a second closure member sealing the second compartment, so that an internal passage delimited by the tubular wall of the interface device and allowing communication between the first compartment and the second compartment remains closed by a first membrane of the first closure member and a second membrane of the second closure member, wherein the connector is fastened to a first coupler of the first container body and to a second coupler of the second container body, which permit narrowing a distance between the first coupler and the second coupler to obtain a second operative configuration of the container, in which the first opener opens the internal passage by one or more of puncturing and displacing the first membrane and the second opener opens the internal passage by one or more of puncturing and displacing the second membrane, thus allowing mixing between the first content and the second content, and wherein the first configuration of the container is maintained by preventing relative rotation and or relative sliding between the connector and each of the first container body and the second container body, by rigid protecting parts irremovably secured to the connector, which are protruding in opposite directions relative to the connector, in order to prevent displacement of the first and second container bodies towards each other, the rigid protecting parts being two protecting rings that surround the connector in the second operative configuration of the container.

9. The method according to claim 8, wherein the interface device further comprises at least one retainer, involved in maintaining the first configuration, which interferes with displacement from the first insertion position to the second insertion position so that the first insertion position is a predetermined position, and wherein the method further comprises passing from the first insertion position to the second insertion position upon one or more of an actuation action and an unlocking action exerted to one or more of relatively slide and rotate the connector relative to the container bodies to allow the first and second membranes to be respectively displaced by the first and second openers, so that the first and second compartments are open toward the connector and the internal passage thus selectively allowing communication between the first compartment and the second compartment.

* * * * *